US006212805B1

(12) United States Patent
Hill

(10) Patent No.: US 6,212,805 B1
(45) Date of Patent: Apr. 10, 2001

(54) PANEL WITH LIGHT PERMEABLE IMAGES

(75) Inventor: George Roland Hill, Stockport (GB)

(73) Assignee: Contra Vision Limited, Cheshire (GB)

( * ) Notice: Subject to any disclaimer, the term of this patent is extended or adjusted under 35 U.S.C. 154(b) by 0 days.

(21) Appl. No.: 09/101,238

(22) PCT Filed: Jan. 6, 1997

(86) PCT No.: PCT/GB97/00020

§ 371 Date: Jul. 6, 1998

§ 102(e) Date: Jul. 6, 1998

(87) PCT Pub. No.: WO97/25213

PCT Pub. Date: Jul. 17, 1997

(30) Foreign Application Priority Data

Jan. 6, 1996 (GB) ..... 9600247

(51) Int. Cl.[7] ..... G09F 13/00
(52) U.S. Cl. ..... 40/443; 40/442; 40/615
(58) Field of Search ..... 40/443, 442, 615

(56) References Cited

U.S. PATENT DOCUMENTS 3,884,559 * 5/1975 Baba ..... 40/615 X
5,106,126 * 4/1992 Longobardi et al. ..... 283/94
5,144,328 * 9/1992 Blake et al. ..... 40/443 X
5,407,711 * 4/1995 Lovison et al. ..... 40/615 X

FOREIGN PATENT DOCUMENTS 656 265 6/1995 (EP) .
2 165 292 4/1986 (GB) .
2 169 239 7/1986 (GB) .
88 00533 1/1988 (WO) .
92 05535 4/1992 (WO) .
96 20840 7/1996 (WO) .

* cited by examiner

*Primary Examiner*—Terry Lee Melius
*Assistant Examiner*—James M Hewitt
(74) *Attorney, Agent, or Firm*—Pillsbury Madison & Sutro LLP

(57) ABSTRACT

A panel includes a sheet of light permeable, preferably optically clear transparent material and a transparent or translucent design superimposed on or forming part of a transparent or translucent base pattern. The design is visible from one side of the panel and a mirror image of the design is visible from the other side of the panel when a sufficiently high level of illuminated is provided on either side or both sides of the panel.

49 Claims, 9 Drawing Sheets

PANEL WITH LIGHT PERMEABLE IMAGES

This application is the national phase of international application PCT/GB97/00020 filed Jan. 6, 1997 which designated the U.S.

FIELD OF THE INVENTION

This invention relates to panels and more particularly light permeable panels that are partially imaged with at least one design that is also light permeable.

The term "light permeable" as used herein includes transparent materials, translucent materials and perforated materials. Transparent materials may have two parallel, plane surfaces or otherwise allow clarity of vision through the panel material, enabling the eye to focus on objects on the other side of the material and provide an undistorted image or may have at least one surface of the transparent material not plane and/or not parallel with another surface, such as to give a distorted image effect. Perforated materials have perforation holes which allow light permeability.

Partially imaged light permeable panels are already known in several fields and are typically used to control visibility of the panel, visibility of any image on one side of the panel, such as a graphic design, and visibility through the panel from one side to the other side, and vice versa.

The incorporation of an opaque pattern on or into particular types of light permeable panels, in order to create unidirectional vision, is already known, for example in the construction of transparent walled squash courts. These panels typically include a continuum opaque pattern applied in a single color, or with the pattern appearing one color from one side of the panel but another color from the other side, to enhance the one-way vision effect when one side of the panel is illuminated more than the other side. A single color pattern is normally white or a light color and a two color pattern is normally arranged to be white or light color on the one side of the panel and black or dark color on the other side of the panel, superimposed with exact or near exact registration, an arrangement which enhances the clarity of vision from the other side to the one side. Such materials can be used to enable spectators or television cameras to see through a squash court wall from the other side while players on the one side can see the wall and cannot see clearly through the wall to the other side. The pattern in such panels is normally one of small dots such that, the eye of a spectator in the audience who is at a distance from the panel cannot discern the individual elements of the pattern, the elements being too small for the eye to resolve.

A simple unidirectional vision panel comprises an opaque pattern of dots 1 mm diameter at 1.4 mm centers on a square grid appearing white from one side and black from the other side, the other side being less illuminated that the one side. Light incident on the white dots is reflected and scattered, which has the effect of obscuring visibility from the one side into the other side. However, a substantially clear view is obtained from the other side through the panel into the one side, albeit the intensity of light of the image is reduced by virtue of the degree of opacity, giving a "toned down" effect to the image, not dissimilar to tinted transparent panels. Such products are described in GB Patent No. 2118096.

Light permeable panels having an opaque "silhouette pattern" and a design which is superimposed on or forms part of a "silhouette pattern" on one or both sides of the panel are also known, as described in GB. Patent No. 2165292 (sometimes referred to hereinafter as "the '292 invention"). Such panels are used for a variety of purposes, such as advertisements on the windows of retail windows, buses and taxis. Typically, a design of an advertisement is visible from outside the window while, from the inside, the design is not visible and an observer has a substantially unobstructed view out. In GB Pat. No. 2165292, the "silhouette pattern" is defined to mean any arrangement of opaque material which sub-divides the panel into a plurality of opaque areas and/or a plurality of transparent or translucent areas.

For advertisements, the silhouette pattern covers a sufficient percentage of the panel area, typically between 35% to 80%, and the design comprises sufficiently bright and varied colors, that the eye is attracted to the design and not the objects on the other side of the panel, thus providing an impactful advertisement from outside. The silhouette pattern on the inside is typically colored black, which provides a tinted view from the inside to the outside.

However, it is a feature of the invention of GB Pat. No. 2165292 that "the design becomes decreasingly perceptible from the side of the panel from which the design is normally visible as the level of illumination from the other side increases", which may be referred to as the "decreasingly perceptible" feature.

FIG. 32 of GB Pat. No. 2165292 discloses 36 distinct vision control options enabled by the '292 invention. Columns 5 and 6 of FIG. 32 illustrate another feature of the '292 invention, that "the design and/or silhouette pattern is substantially imperceptible from the side of the panel from which said design and/or silhouette pattern is normally visible when the level of illumination transmitted through the panel from the other side of the panel substantially exceeds the light reflected from the said one side of the panel". This feature may be referred to as the "substantially imperceptible" feature.

A further feature of panels according to GB Pat. No. 2165292 is that "a principal perceived image when viewing a panel changes from the design to a space on the other side when the illumination is altered from relative light on the one side and relative dark on the other side to relative light on the other side and relative dark on the one side." The principal perceived image in the space on the other side is intended to include sources of illumination or objects or surfaces in the space on the other side. This feature may be referred to as the "principle perceived image" feature.

These features, of the design becoming less perceptible and eventually becoming imperceptible, as the level of illumination on the other side of the panel is raised increasingly higher relative to the level of illumination on the side from which the design is being observed, have been a problem to the exploitation of the '292 invention in certain situations. For example, if an advertisement of the '292 invention is placed on a retail window, the design will typically be visible in the hours of daylight. However, if there is not relatively high artificial illumination outside the retail premises during the hours of darkness, or the level of internal illumination of the retail premises is particularly high during the hours of daylight, such advertisements may be substantially imperceptible or not have sufficient visual impact for commercial purposes, the principal perceived image being the inside of the retail premises and not the design. It is typically desirable in such applications to have optional vision of the advertisement and the view inside, for security reasons. The brain can concentrate on the design or the view through the panel, as required. In some parts of the world, where night-time robberies are relatively commonplace, it can be regarded as an advantage for the principal perceived image to change from the design on the advertisement in the hours of daylight, to the interior space in the hours of darkness. However, in situations where the advertiser wishes to have an easily seen advertisement at all times, under all pertaining lighting conditions, the feature of the design being decreasingly perceptible with increasing relative illumination on the other side is a significant problem and limits the exploitation of the '292 invention.

Also well known are "backlit" signs, which typically consist of a transparent and/or translucent design on a front panel and an enclosed sign box. A typical sign box contains an internal illumination device of one or more sources of illumination, typically an array of fluorescent light tubes, which illuminate the front panel from behind. Other "slim-line" backlit signs typically rely on the edge illumination of a transparent material, such as an acrylic sheet, which incorporate an array of prismatic surfaces or etched lines of varying thickness or is wedge shaped or otherwise provides a relatively uniform emission of light throughout one surface of the edge lit panel. The design on the front panel is normally visible in ambient lighting conditions but the perceived image of the design is substantially intensified when the illumination device is switched on, illuminating the sign from behind. Front panels typically comprise a photographic transparency or are printed. It has been found that backlit sign front panels can be advantageously produced by printing a design on one side of a translucent white plastic material and the "verso" or mirror image of the design is printed on the other side of the translucent white material, the two design impressions being substantially aligned or 'in register'. This arrangement produces a reinforced color effect and, with four colour printing of a photographic image, a more realistic perceived image when illuminated. Also known are alternating backlit signs which comprise a transparent mask film with a regular pattern of opaque lines located in front of a backlit sign front panel transparency. The front panel transparency typically comprises alternating bands of a first and a second different image, the band widths being the same width as the opaque lines and forming a continuous composite transparency. The mask film is caused to move so that the opaque lines alternately mask the first or second images, thus providing an alternating sign. Also known is an alternating sign achieved by locating a panel of the '292 invention in front of a backlit sign. When the sign illumination is switched off or down to a very low luminous intensity, the design on the panel of the '292 invention is visible. When the sign illumination is switched on or increased to a sufficiently high luminous intensity, the design on the front panel of the backlit sign becomes the principal perceived image.

SUMMARY OF THE INVENTION

According to one aspect of the present invention there is provided a panel comprising a sheet of light permeable material and a transparent or translucent design superimposed on or forming part of a base pattern (as herein defined), said design being visible from one side of the panel and a mirror image of said design being visible from the other side of the panel when a sufficiently high level of illumination is provided on either side or both sides of the panel.

According to another aspect of the invention there is provided a panel comprising a sheet of optically clear transparent material and a translucent design (as herein defined) superimposed on or forming part of a base pattern (as herein defined), said design being visible from one side of the panel and a mirror image of said design being visible from the other side of the panel when a sufficiently high level of illumination is provided on said one and/or said other side of the panel.

According to another aspect of the invention there is provided a sheet of optically clear transparent material and a translucent design (as herein defined) superimposed on a base pattern (as herein defined), said base pattern comprising a layer of translucent material, said design being visible from one side of the panel and a mirror image of said design being visible from the other side of the panel when a sufficiently high level of illumination is provided on said one and/or said other side of the panel.

According to another aspect of the invention there is provided a sheet of optically clear transparent material and a translucent design (as herein defined) superimposed on one side of a base pattern (as herein defined), said base pattern comprising a layer of translucent material, and a mirror image of said design is superimposed on the other side of said base pattern.

A number of different vision effects are obtainable from the above aspects of the invention and different lighting conditions. A design can be visible from one side of a panel and not visible from the other side. A mirror image of the design can be visible from the other side of the panel but not from the one side. Clarity of vision can be maintained from the one side to the other side with or without the exception of the area covered by the design with clarity of vision through the other side of the panel with or without the exception of the area covered by the design. Visibility from the one side to the other side can be totally or partially obstructed throughout the area of the panel while there is clear or partially obstructed vision through the whole of the panel from the other side to the one side. Clear or partially obstructed vision is obtainable through the whole of the panel from the one side to the other side while visibility throughout the whole of the panel from the other side to the one side is totally or partially obstructed. Vision from either side can be totally or partially obstructed throughout the area of the panel.

In all cases through vision can be obtained in either direction through the panel when the level of illumination perceived through the panel from the far side of the panel sufficiently exceeds the illumination reflected from and/or transmitted through the base pattern and any design when observed from the near side of the panel.

The panels of the invention can be illuminated and/or the or each design arranged thereon such that the eye will tend to concentrate upon the design on the panel or look through the panel and concentrate on an object or objects beyond the panel. When viewed from the other side of the panel an observer can concentrate upon the mirror image of the design visible on said one side or look through the panel and concentrate on an object or objects beyond the panel.

In addition, it is a principal feature of the invention that any illumination on or of the far side of the panel will illuminate the design visible from the near side of the panel, owing to the transparent or translucent nature of the design and base pattern. Depending primarily on the proportion of the area of the panel covered by the base pattern, the design colors and the coefficients of light transmissivity of the design and base pattern and ambient lighting conditions, an increase in the level of illumination on the far side of the panel may increase or decrease the perceptibility of the design in relation to the perceptibility of any object or objects illuminated on the far side of the panel.

In all cases, it is a feature that 'spotlighting' (as defined herein) the far side of a panel of the invention will tend to increase the perceptibility of a design facing the near side of the panel, if the other conditions of illumination to either side of the panel are unchanged. It is possible to arrange the panel construction and conditions of illumination of a panel such that when a design on the panel is normally observed from one side, that the principal perceived image changes from an object spaced from the other side of a panel to the design on the panel by sufficient 'spotlighting' directed onto the other side of the panel without changing any of the other conditions of illumination.

The design on one or both sides may be decorative and/or informative or for other purposes. The panel of the invention may also allow for the control of solar heat gain, glare or UV radiation received within for example, a building, vehicle or other enclosure or shelter without unduly affecting the visibility outwards.

The invention allows the natural or artificial illumination of space to either side from the other side, so that, for example, a panel of the invention forming an advertisement can be placed in a window of a building and still allow daylight to enter the window, albeit of reduced intensity, coupled with vision out of the building.

The design on the panel is superimposed on or forms part of a pattern of transparent or translucent elements which is referred to herein as a "base pattern". The term "base pattern" as used herein is intended to mean any arrangement of transparent or translucent material which is differently colored to the "neutral background" of the panel.

The term "neutral background" as used herein is intended to mean the color or colorless nature of any transparent or translucent sheets of material within the panel or the areas of holes within a perforated material comprising a light permeable material within the panel.

The term "optically clear transparent material" as used herein is intended to mean a transparent material that has two substantially parallel and plane surfaces or otherwise allows clarity of vision from one side of the material through the material, enabling the eye to focus on an object spaced from the other side of the material and thus providing a substantially undistorted image of the object. The material does not have to be colorless or "water clear" but may be tinted.

The term "translucent material" as used herein is intended to mean a material which will allow light transmission but is not an optically clear transparent material (as defined herein).

The term "translucent design" as used herein is intended to mean a design comprising a translucent material (as defined herein). The design typically comprises translucent inks, toners or other marking materials. Another part of a translucent design may be opaque. Another part of a translucent design may comprise optically clear transparent material.

The "base pattern" subdivides the panel into a plurality of transparent or translucent base pattern areas and/or a plurality of neutral background areas. The base pattern may be in many forms, for example it may be a regular geometric element in a regular layout, such as a pattern of dots, a regular geometric element in an irregular layout, a free form element in a regular layout, a free form element in an irregular layout or a combination of regular and free-form elements in regular and/or irregular layouts. Instead of a number of separate elements with an interconnected neutral background zone, the base pattern can be a pattern of separate base pattern elements and separate neutral background areas, such as a pattern of lines. The base pattern may be formed by interconnected base pattern elements with separate neutral background areas, such as a net, grid or mesh pattern. The base pattern can, if desired, be a combination of interconnected base pattern elements and separate base pattern elements.

All of such base patterns may be repeated over a unitary panel to produce large areas or a large panel can be made up from smaller panels, for example in the manner of tiles.

The elements forming the base pattern are normally small such as dots preferably of equal size on a regular grid, sometimes referred to in the printing industry as a "halftone", or a pattern of lines, or a grid pattern comprising marking material or perforated material. The base pattern is typically a continuum and provides an even shading of tinting effect in the absence of a design.

The term "design" as used herein is intended to mean any graphic image such as indicia, a photographic image or a multi-color image of any type. The design is typically perceived to be visually independent of the elements of the base pattern. This feature can be tested by an observer adjacent to one side of the panel from which the design is normally visible, who moves away from the one side of the panel in a perpendicular direction from the panel until any individual element of the base pattern can no longer be resolved by the eye of the observer, the design remaining clearly perceptible.

A cross-section taken through a panel of the invention typically comprises two outer edges of a sheet of optically clear transparent material and alternate transparent portions and translucent portions of said base pattern, at least one of said translucent portions comprising a part of said design.

In order for the perceptibility of the design to dominate perceptibility of elements of the base pattern or the transparent areas, it is recommended that a panel be constructed such that a cross-section can be taken through any point within the area of a panel such that the average width of the translucent portions is less than 6 mm and the average width of the transparent portions is less than 3 mm. If a panel of the invention is intended to be principally observed from a distance of less than 1 m, it is recommended that the average width of the translucent portions and the average width of the transparent portions both be less than 2 mm.

This invention has some similar characteristics to that of GB Pat No 2165292, in that there is a sheet of light permeable material, and a percentage of the light permeable material is not imaged, typically to allow the desired degree of through vision or light transmission in either direction, and the panel is partially provided with a pattern and a design is superimposed on or forms part of the pattern. However, instead of being opaque, the base pattern and design are light permeable, of either translucent or transparent colors that allow light to pass through the base pattern, as well as to pass through the portions of the light permeable sheet that are not imaged. There are a number of advantages of the present invention compared to the prior art.

According to one aspect of the present invention, any illumination of the far side of the panel will illuminate the transparent or translucent design image as seen from the near side of the panel, in a similar manner to a "backlit" sign. Thus while any increase in illumination on the far side of the panel will tend to increase the visibility of objects on the far side of the panel, this effect will be compensated to some degree by an increase in the illumination of the design by virtue of the rear illumination passing through the translucent material and thus intensifying the design image. In this manner, providing sources of light or very highly illuminated surfaces are not placed directly behind a panel, the design typically remains visible, even in conditions of reasonably high illumination on the far side of the panel. The invention thus overcomes the previously outlined problem of the prior art of the '292 invention, in which the design becomes less perceptible or imperceptible under such conditions of increased illumination on the far side. There are many other benefits of the invention.

The invention is radically different from existing backlit signs, in that it allows visibility through the panel in either direction. This feature, for example, enables panels of the invention to be applied to existing windows without preventing vision out or in, as would be the case with a conventional front panel of a backlit sign. Another critical difference between the present invention and the front panel of a backlit sign is that when the luminous intensity of light sources directly behind a backlit sign is increased the design on the front panel becomes correspondingly more perceptible. However, a similar increase in the luminous intensity of light sources directly behind a panel of the present invention will typically not cause the design to be more perceptible and typically will cause it to be less perceptible the greater the increase in luminous intensity, as the perceptibility of the light sources directly behind the panel will dominate over the perceptibility of the design. In order to effectively increase the perceptibility of a design on one side of a panel of the present invention, compared to the "through image" of the other side of the panel, by means of increased illumination on the other side, it is typically necessary to locate the source of illumination outside the line of sight of the observer. For example, if a panel of the invention located in a window of a building, a spotlight on the ceiling of a room in the building will be directed so that its light is concentrated on the other side of the panel. The spotlight source of light should not be visible to an observer outside, or at least it should not be within his line of sight of any part of the panel. Any increase in such direct spotlighting of the other side of the panel will increase the perceptibility of the design and decrease the perceptibility of the image on the other side of the panel, being the interior space of the building behind the window, assuming other illumination conditions remain the same. Such spotlighting would provide no increase in the perceptibility of the design of a panel of the '292 invention and would typically reduce the perceptibility of the design by virtue of the spotlighting being partially reflected off the window to increase the illumination of the interior space.

Thus the invention has advantageous features which are different from and indeed opposite to those of the prior art of both the '292 invention and existing backlit signs.

A panel of the invention comprises a sheet of transparent or translucent imperforate material or a perforated material. A transparent or translucent material can be a rigid sheet or a flexible film and can be "water clear" or stained or otherwise tinted. For example, the invention may comprise paper or transparent or translucent plastics film, either calendered, extruded, cast or blown, such as polyvinylchloride film or polyethylene film or polypropylene film or polyester film. Transparent or translucent rigid sheet materials which may form the sheet of light permeable material include glass, acrylic, polycarbonate or polyvinyl chloride sheets. Transparent materials may be optically clear to see through such as a typical pane of window glass or sheet of acrylic with two, parallel, plane surfaces that allow an observer on one side of a panel to focus sharply on an object spaced from the other side of the panel. Alternatively, such materials may be 'deformé' (not plane) or otherwise treated on one or both surfaces to give a distorted image of any objects seen through the material. Translucent materials to which the invention may be applied include the above materials, but are dyed, pigmented or otherwise caused to be translucent, allowing light to pass through the material but preventing an observer focusing upon any object spaced on the other side of a panel when vision is attempted through the material. Perforated materials which may form the sheet of light permeable material include any of the above materials.

The base pattern and any design are typically applied to a sheet of light permeable material using marking material, such as printing inks, dyes or electrostatic printing powder or liquid toners, but may comprise tinted film or other materials. A perforated translucent material may be used to form the base pattern onto which the design is superimposed or a perforated transparent material may be used to define the base pattern. The base pattern and design may be applied by any imaging process, such as airbrushing, any digital printing system such as ink jet printing, screen printing, offset litho printing and gravure printing. The design and/or base pattern may be applied by transfer from a carrying surface or membrane, such as electronic imaging by such processes as 3M Scotchprint (Trade Marks of 3M) or ceramic ink transfer, the ceramic ink to be typically fused into toughened glass.

The inks or other marking materials or other materials forming the base pattern and design should be transparent or translucent, such as traditional offset litho printing inks or the inks, dyes or toners used in digital printing, which are also typically light permeable. Designs may comprise multicolor printing systems such as two colour or four color process systems, typically on an additional color background, typically white.

In one embodiment of the invention, the base pattern comprises translucent white ink to form a white translucent base pattern layer onto one side of a sheet of transparent material, such as water clear, transparent polyester film. The design is printed superimposed onto the white base pattern layer using transparent or translucent inks, by any of the methods disclosed above or in GB Pat. No. 2165292 or in patent applications PCT/GB96/00002 or PCT/GB96/02600 or any other methods to achieve close or substantially exact registration of the design in relation to the base pattern. In all panels of the invention, it is important to consider and provide a suitable average light transmissivity of the design and base pattern, to achieve the desired optical performance. The design may be masked by the white ink and be substantially invisible from the other side of the panel, particularly if the design inks are maintained within the area of the base pattern layer and there is no or a low level of illumination on the one side of the panel. However, the design is visible from the said one side of the panel and a mirror image of this design is visible from the other side of the panel when a sufficiently high level of illumination is directed onto the said one side of the panel. When viewed from either side, any objects spaced from the far side of the panel will normally be optionally visible, for example with substantially the same conditions of illumination of the panel and the space on both sides. The eye can see the design on the panel, or see through the panel, as the brain selects. In this example, the design is printed 'recto', a term used herein as used conventionally in the printing industry, for a design printed on a surface facing the direction of the one side of the panel from which it is primarily intended to be seen, sometimes termed the obverse side. If the design is printed onto a surface on the other side of the panel but facing towards the one side of the panel, the design is said to be printed 'verso', that is to say a mirror image of the design is printed, which will appear as the mirror image of the design from the said other, reverse side of the panel and will be seen as the design if seen from the said one side of the panel.

In another embodiment of the invention, the other side of a transparent or translucent material is imaged with the base pattern using white translucent ink and the 'verso' or mirror image of the design is applied to the other side of the white translucent base pattern layer. The mirror image of the design will be visible from the said other side of the panel. The design will not be visible or not as visible from the said one side of the panel. However, when the level of illumination of the said other side of the panel is sufficiently high, the design will be visible from the said one side through the translucent white base layer. When viewed from either side, any objects on the opposite side of the panel will typically be visible, for example under substantially the same conditions of illumination of the panel and the space on both sides.

In a preferred embodiment of the invention, a transparent material such as water clear, transparent polyester film is printed with a design 'recto' onto one side of the film, to be followed by the base pattern layer of one or more layers of white translucent ink, to be followed by the design again printed 'recto' onto the base pattern layer, using one of the methods of achieving close or substantially exact registration of the successive layers of ink previously referred to. In this preferred embodiment, the design is normally clearly visible from the said one side of the panel and the mirror image of the design is normally clearly visible from the said other side of the panel under the variety of lighting conditions encountered in a practical application of the invention. The partial imaging of two 'recto' designe either side of a translucent white ink base layer, according to this preferred embodiment of the invention, provides a number of advantages, in that the design or the mirror image of the design is readily visible from the respective sides of the panel and optional visibility of any objects on the opposite side of the panel is typically maintained.

In another embodiment of the invention, a similar effect can be achieved by printing a 'verse' design image on the other side of the transparent film, then applying a white translucent ink base pattern layer and then printing a 'verse' design on the other side of the white translucent base pattern layer. Such a panel provides the additional benefit of typically being applied inside a building or vehicle window, protected from the outside weather, but the design being visible from the outside.

In another embodiment of the invention, the light permeable material is a preforated material, such as performed paper or perforated white or clear polyvinylchloride film, polyethylene film, polyester film or polypropylene film, the perforated holes allowing vision through the panel. The paper or film material which has not been removed in perforation defines the base pattern. This perforated material is imaged with transparent or translucent marking materials, as required, to provide the required design and base pattern colours and the required light transmissivity of the base pattern and/or design and/or mirror image of the design. For example, one side of a water-clear perforated plastic film is printed with a design 'recto', then one or more layers of white translucent ink forming a translucent base pattern layer are applied throughout the base pattern, followed by the design printed 'recto' once again. The design is visible from the said one side of the panel and the mirror image of the design is visible from the other side of the panel. The percentage of holes in the preforated film typically varies from 55 per cent to 10 per cent of holes (45 per cent to 90 per cent base pattern), depending on the optical performance characteristics required of the design impact and vision through the panel, in each direction, bearing in mind the lighting conditions to which the panel will be subjected in use. For a high visibility of design, a high percentage of base pattern should be provided and/or a high level of illuminance at the design surface on the panel.

In another embodiment of the invention, utilising transparent unperforated or perforated materials, the base pattern does not comprise a separate layer but the translucent design is printed photographically or otherwise imaged, for example by four or five color process printing, so as to appear similar to a photographic transparency but with the neutral background area or areas unimaged.

In the previously described embodiments, the paper or plastic film way advantageously be applied to a window by self-adhesive, typically a water-clear acrylic pressure-sensitive adhesive, the adhesive being temporarily protected by a siliconised filmic or paper liner on the opposite side of the self-adhesive to the film. The liner is removed before attaching the film to the window by means of the adhesive.

A translucent base layer covering a design can prevent visibility of the design form one side under certain lighting conditions, typically relatively high illumination of the base layer compared to the design from the other side of the base layer. However, when sufficient illumination is provided on the other side of the panel, the design will be visible through the translucent base layer. This feature can be used to create an alternating sign, the design being alternately invisible and visible as a light source directed from behind and onto the panel is switched on and off. When the light sources is switched off, objects in the space on the other side are typically visible. Thus for example, a panel on the window of a shop can provide alternating vision of the design on the panel and the interior of the shop.

The design image perceived and its intensity, and the visibility through a panel of the invention, depend upon a number of factors including the lighting conditions on either side of the panel, the light transmissivity and surface reflectivity of the transparent or translucent materials, the reflective refraction characteristics and the contrast of the colors used in the design and/or base pattern, the distinctiveness of the design, the ratio of base pattern area to neutral background area and the shape of the base pattern. Visibility of the design results from light incident from the observer's side of the design being reflected and scattered from the ink or other marking material forming the design, or light incident on the other side of the panel which is refracted through and scatters from the ink or other marking material from the design and the base pattern.

Conditions, can be such as to allow the eye to see the design or to see through the design beyond an imaged transparent material, depending inter alia upon the focus of attention of the viewing person, and upon the proximity of the viewing person to the panel, as well as the other factors listed above as affecting the perception of a design image.

The design perceived from one side and the mirror image of the design perceived from the other side can be enhanced by spotlight illumination of the panel from either or both sides, preferably directed to avoid illumination through the panel of objects that are visible through the panel from a normal viewing position of the panel. Such Spotlighting is normally directed downwards, for example onto a panel on a window from an external canopy or internal ceiling position. As another example, a panel on an internal glass partition is illuminated by spotlighting directed downwards from the ceiling on one or both sides of the panel. Because of the refraction, reflection and scattering of rays from such lighting which is incident upon a design of marking material, the effect is to enhance any design image seen by an observer. The observer does not have to be aligned with such spotlighting to gain the benefit of an enhanced image. A proportion of the light from such spotlighting passes directly through the neutral background transparent parts of the panel onto an area of the floor on the opposite side of the panel, that is not in the direct line of sight of an observer through the panel. In this way, the visibility of a design can be greatly enhanced by concentrated rear illumination, while maintaining the desired degree of visibility through the panel in either direction, which is not possible with, and represents a major advantage over, the prior art using an opaque pattern or panels with a continuous transparent or translucent design providing no vision through the panel.

The terms 'spotlights' or 'spotlighting', as used herein, are intended to mean any system of artificial illumination which is focused, directed or otherwise concentrated onto a panel or the invention. Typically, a light source such as a general light source bulb (GLS), a tungsten halogen lamp, a metal halide lamp or a fluorescent or compact fluorescent tube may be silvered or otherwise made reflective over part of their surface or they may be combined with an optical reflector system and/or an optical prism system and/or a shading system to enable a targeting the required area of illumination, in this case a panel of the invention, and to prevent or limit incident light on other surfaces. Thus the term "spotlighting", as used herein, is not limited to a narrowly focussed beam of say 10' angle of distribution but includes 'flood' beams of say 25' angle, "wide flood" beams of say 40' angle and even "very wide flood" beams of say 60' angle, if they are located at a distance such that the beam is concentrated on (approximately subtended by) the panel of the invention. One example is a spotlight fixed to a ceiling which is directed onto the panel but not a substantial area outside the panel perimeter. Other examples of 'spotlights' include the type of luminaires known as 'picture lights', 'blackboard lights' and 'billboard lights', which are designed to provide a relatively uniform illumination of a panel, typically a rectangular vertical panel, the luminaire typically being in a position outside the space defined by perpendicular projection from the perimeter of the panel. Such luminaires are normally used to illuminate the front or obverse side of a opaque panel such as a picture or billboard without illuminating other surfaces or obstructing vision of the panel. The same type of luminaires can advantageously be used to illuminate the panels of the present invention with a design feeling one side by their light being directed or concentrated on the other side of the panel. This desirable feature of illumination by a rear 'spotlight' may be arranged even more advantageously by ensuring that the observer's eye is outside the beam or space that is illuminated by the 'spotlight'. It is additionally advantageous to shield the observer's eye from the actual light source, even if directed away from the observer's eye, as sources of illumination appear bright and any such brightness in the field of vision of the observer will tend to detract from the perceptibility of the design. It is often not realised that not only do designs on panels of the '292 invention become decreasingly perceptible with an increase in the level of illumination behind a panel but that designs on an opaque substrate such as solid paper or plastic film will become decreasingly perceptible and may become completely imperceptible if there is a surrounding brightly illuminated area. For example, the design on a conventional opaque poster on a shop window will typically be invisible or not clearly visible during the hours of darkness unless there is good front illumination of the poster. The pupil of the observer's eye adjusts to the general light level within the field of vision, such as a brightly illuminated shop interior, and can then not discern the design on the opaque poster.

In contrast, suitable spotlighting of a panel of the invention from inside the chop will enable the design to be clearly visible under the otherwise same lighting conditions. Ideally such spotlighting should be arranged so that the normally intended opportunities for viewing the design will result in the observer's eye being outside the space defined by a geometrical projection of the panel by the light source, which may be termed the "projected panel volume" on the observer's side of the panel, as illustrated in FIG. 3. Thus the source of the spotlight will not be in the direct line of eight from the observer's eye to any part of the panel. Also, the spotlighting which is incident upon any optically clear transparent area of the panel (typically forming the neutral background) will be directed towards the ground and not significantly detract from visibility of the design. Such spotlighting would not benefit and indeed would tend to detract from the visibility of the same design on opaque panels or panels of the '292 invention because of internal reflection adding to the illumination of the internal space.

Of course, spotlighting on the front, observer, recto side of a design will also improve perceptibility of the design but this is often not easy to arrange, for example illumination of a panel on a shop window from outside is often not permitted by reasons of space ownership, lease conditions or public planning or zoning restrictions. Thus the invention has unique advantages over the prior art in being capable of illumination from inside a building to be visible from the outside, as well as providing visibility through the panel.

The perceptibility by an observer of the design on one side of a panel and the perceptibility of the "through image" of the space and any light sources, objects, walls or other surfaces in the space on the other side of the panel may be assessed more precisely as follows.

The ratio of the base pattern area to the transparent area can be established for any base pattern. For example, consider a panel in which the base pattern is a regular pattern of straight lines of equal width and equal spacing between lines. The ratio of the width of the translucent base pattern lines to the width of the transparent spaces between the base pattern lines represents the ratio of the base pattern area to the transparent area.

Typical ratio would be base pattern transparent area of 1:1 to 4:1. The greater the proportion of base pattern compared to the transparent area, the greater the perceptibility of the design compared to the "through image" of what is on the other side, and vice versa. The greater the luminance (cd/m$^2$) of the base pattern compared to the luminance of the transparent area, from the observer's side of the panel, the greater the perceptibility of the design compared to the "through image" and vice versa. Experimental tests undertaken to compare the performance of a panel of the invention with a panel of the '292 invention using an identical geometrical pattern for the base pattern and silhouette pattern respectively (covering 80% of the panel area), on identical sheets of optically clear transparent material and with an identical range of 32 different lighting conditions, measured by means of a luminance meter and human perceptibility appraised by a number of observers, show that roar illumination of a panel of the invention by one or two spotlights outside the direct line of sight of the observer provides a dramatic improvement to the perceptibility of a panel of the invention, whereas it has no perceptible effect on a panel of the '292 invention. Depending upon the ambient lighting conditions, the luminance of the panel is increased to up to seven times the luminance of a panel of the '292 invention under identical conditions, the minimum recorded benefit in luminance being approximately twice that of the panel of the '292 invention. The human perceptibility of a panel of the invention improves by as such as from "surface not visible" (0 on a perceptibility scale of 0 to 4) to "surface visible, detail very discernible" (4 on a perceptibility scale of 0 to 4).

In addition to the previously mentioned factors, the improvement in perceptibility of the design by spotlighting the other side of a panel is dependent upon the luminous intensity of the spotlights and their distance from the panel and the light transmissivity of the design and base pattern, which will typically vary over the area of the design, typically being highest in areas of white or other light colour and darkest in areas of black or other dark colour. It is found to be typically preferable to arrange the panel such that the average light transmissivity of the panel over the area of the design and base pattern is greater than 3.0% of incident light on the panel and that areas of white have a light transmissivity of preferably greater than 5.0%. However, panels with an average light transmissivity of the design and base pattern of as low as 1% can offer functional advantages compared to panels according to the prior art. For most panels, for example panels used for window advertisements, it is found to be preferable to have a relatively high proportions of base pattern such as 1.6 mm wide lines at 2 mm centers, which provides a base pattern:transparent area ratio of 4:1.

The visibility of perceptibility of a design compared to the "through image" will always be increased by suitable "spotlighting" as described above, directed onto the far side of a panel of the present invention. The effect of increasing the general (illumination of the space and any objects, walls or other surfaces in the space on the other side can be assessed by first establishing the ratio of base pattern to transparent area and the light transmissivity of the design and base pattern and that of the transparent area. It is then possible to calculate the ratio of light transmission through the design and base pattern compared to the light transmission through the transparent area, which can be considered to represent the luminance of the design and base pattern:luminance of the transparent area (which in turn provides a good approximation of the visibility of the design:visibility of the "through image). For example, if a panel with a base pattern:transparent area ratio of 4:1 has a transparent material light transmissivity of 90% and an average transmissivity of 5% through the design, base pattern and transparent material, then the resulting light transmission ratio resulting from general illumination of the space behind would be:

$$\frac{4\times5}{100}\cdot\frac{1\times90}{100}=2:9$$

meaning that increasing the general illumination behind the panel would decreases perceptibility of the design. However, if the combined transmissivity of the design and base pattern and transparent material was 30%, the ratio would be $$\frac{4\times30}{100}\cdot\frac{1\times90}{100}=4:3$$

meaning that increasing the general illumination behind the panel would increase perceptibility of the design. Typically, spotlight illumination directed onto the front or rear of a panel is required to achieve substantial improvement in design visibility compared to "through image" visibility.

The typical feature of the principal perceived image changing from the "through image" to the design on one side of a panel by spotlighting the other side of the panel may be tested as follows. An observer is located at a suitable distance, typically 1–2 m, on the one side of the panel. An object is placed at a suitable distance, typically 1–2 m, from the other side of the panel. Illumination on both sides of the panel is totally or substantially eliminated. Then the level of illumination is gradually raised on the other side of the panel only, either by spotlighting the object or general illumination encompassing the object. The illumination should only be raised to a level at which the object is readily discernible, with or without any surrounding objects, such that the "through image" forms the observer's principal perceived image. Without changing other conditions of illumination, spotlight illumination is then directed onto the other side of the panel. The spotlight illumination is raised to a level at which the principal perceived image changes from the "through image" to the design on the panel.

In another embodiment, the light permeable material is a tinted light permeable material, such as a polyester film dyed a 'neutral' grey tint, which also will increase the one-way effect of a base pattern and design applied to one side of a panel, typically partially or totally obscuring vision through the panel from the one side, while maintaining visibility from the other side to the one side.

In another embodiment, a transparent or translucent base portion and design may be applied to a light permeable material comprising a partially metallised mirror material, such as is typically used as a one-way mirror or as 'solar glazing', to reflect a proportion of solar radiation to reduce heat gain, solar glare and UV degradation inside a building. Such products increase the one-way effect of either a panel of the invention in isolation or the partially metallised material in isolation, and enable hold advertisements or designs on one side of a panel while maintaining visibility through the panel from the opposite side. The principal advantage of the invention, that a design can be made more perceptible by illumination from either side or both sides of a panel, still applies to embodiments incorporating partially metallised materials.

In another embodiment, a partially or totally metallised mirror material is placed at a distance behind a panel of the present invention. When viewed from the design side the mirror reflects the 'verso' image into a 'recto' image, perceived to be twice the distance away from the panel as the distance to the mirror surface, which leads to a variety of interacting visual effects, of practical value in promotional and other fields. If the mirror is partially mirrored, vision is still enabled through the partial mirror and the panel of the invention, from the other side of the partial mirror. This has many useful applications, for example, as a covert observation device disguised as a promotional sign.

Preferred methods of producing the design and base pattern include the use or adaptations of those methods for producing a design and silhouette pattern disclosed in GB Patent No. 2165292. Some of these methods utilise differential adhesion of different ink layers to achieve substantially exact registration, as disclosed in FIGS. 20 and 21 of the '292 patent. Another preferred method utilises conventional printing methods with a dimensional registration tolerance system to achieve consistent visual images, described as the Overlap Method in GB Patent No. 2165292. Improvements to such methods of partial imaging are disclosed in patent application PCT/GB96/02600. A particular advantage of the present invention, in which opacity is not required, is that offset litho or digital printing systems, that typically use transparent or transiucent inks, can be used without the need to build up many layers of ink to achieve opacity, as is required for the '292 invention. For example, with litho printing, as many as six layers of black and eight layers of white ink are required to achieve an opaque background white layer to a design with an opaque black layer behind. For the present invention, one or two layers of white ink are adequate for most embodiments, as a translucent background to a design. Thus the design and base pattern of the present invention may be produced in one pass of a six color offset litho printing press as opposed to three or four passes required for a panel according to GB Patent No. 2165202. The design and base pattern of the present invention may be produced by one or two passes of a four or five color digital printing process, such as ink jet printing. The present invention is typically much easier to print by any litho or digital printing system compared to the '292 invention,, as less layers and therefore less registration of layers is required. Instead of producing the base pattern and design by superimposing layers, they can be co-ordinated in one printing process by means of artwork which is restricted to areas related to elements of the base pattern, for example by means of four color can be produced in one impression, for example by transfer from a carrier layer, for example by means of an electronic imaging system such as 3M Scotchprint (Trade Marks of 3M) or digital offset litho printing by such equipment an Indigo (Trade Mark of Indigo NV). Raster Image Processing techniques can be used to determine the required application of four or five color process inks from a single piece of artwork, such as a conventional photographic image.

The base pattern need only cover part of a panel, the remainder being left without a base pattern. Alternatively, other parts of a panel of the invention may have an opaque "silhouette pattern" according to GB Patent No. 2165292, with a design on one side or a design on both sides, or have one or more relatively large opaque areas onto which indicia or other designs can be superimposed, such arrangements being ideal where a mirror image of a design of indicia or other subject is not acceptable or not preferred. Thus an advertisement might have a pictorial section according to the present invention and a section with indicia forming a promotional message according to GB Patent No. 2165292 in another part of the same panel.

Additional benefit can be obtained if the base pattern can be arranged to be geometrically the same as the opaque silhouette pattern and for the two patterns to be geometrically continuous. Thus a design can appear to be of a consistent perceived quality under certain lighting conditions but a secondary or subliminal design can be incorporated that will only be clearly visible under other lighting conditions. For example, a panel could have a primary design of the name of a shop or product brand. A secondary design, for example the indicia "NIGHT SHOP", could be formed of opaque elements within these indicia, surrounding the base pattern of a continuous, similar geometry. If fixed to a shop window, only the primary design would be visible during the hours of daylight. However, during the hours of darkness, the primary design would be substantially less visible and the secondary design "NIGHT SHOP" would be clearly visible as a silhouette. A related silhouette effect has been created using the '292 invention with a different silhouette pattern with a different percentage opacity for the secondary image, this secondary image being therefore clearly visible at all times. This secondary design feature of the present invention thus represents an improvement over the prior art.

An alternating sign can be achieved using a panel of the invention comprising a sheet of optically clear transparent material as a front design panel in an assembly also incorporating a conventional opaque rear design panel. At least one intermediate light source is provided, preferably offset outside the space defined by the perimeters of the two panels. When the rear design panel is not directly illuminated, the front design panel of the invention is clearly visible owing to the ambient illumination in front of the sign and/or spotlight illumination of the front design panel by an offset intermediate light source. When only the rear design panel is illuminated by an offset intermediate light source, the rear design becomes the principal perceived image as the luminance produced from the illuminated rear design is substantially greater than the luminance of the front design and base pattern. As an alternative to a switching or dimming system to alternate direct illumination of the two design panels by two offset intermediate light sources, a rocking optical reflector system or prism system, typically activated by a rotating cam, can alternate directed light from a single offset light source between the front design panel and the rear design panel. The luminance of the front design panel of the invention can be enhanced by a "Light Redirecting material".

The term "Light Redirecting Material" (LRM), as used herein, is intended to mean one of a range of sheet or film materials with linear prismatic projections or recesses, typically on one surface, or prismatic air voids spaced within an otherwise solid sheet of plastic material, such as acrylic or polycarbonate. One such material is 3M Scotch Optical Lighting Film (SOLF) manufactured by the Minnesota Mining and Manufacturing Company, which has a linear triangular prismatic surface. Another LRM is SERRAGLAZE by de Montford of Lichfield, UK, which incorporates 'air shelves' within a plastic sheet having plane external surfaces. Such materials redirect light incident on their surface within a specified range of angle of incidence, by means of internal reflection. Other terms commonly used for such materials include "light management materials" and "daylight improvement films", as one purpose for such films is to redirect light incident on a building window to a more horizontal light path or to redirect the daylight upwards onto ceilings within the building, the ceilings typically being more reflective than the building floor and thus also increasing the "daylight factor" of the internal illumination of the building.

Existing LRM would typically be counter-productive when used with panels of the present invention as the incident light redirected onto the design would also be redirected through the transparent areas and thus cause glare, detracting from visibility of the design. However, this invention includes new light redirecting materials which have been deviced, and new ways of using some existing Light Redirecting Materials, principally to enhance the visibility of the design without corresponding glare.

Such newly devised materials or applications can be incorporated into panels of the invention for other purposes, such as to enhance privacy glazing. Privacy glazing using panels of the '292 invention cuffers the problem of becoming ineffective during the hours of darkness, as typical internal illumination enables an observer outside to see through panels of the '292 invention, as previously described. The present invention overcomes this problem, typically incorporating internal spotlighting onto the privacy windows, as part of the interior lighting system. Light redirecting materials have been devised of adapted to enhance the visibility of the design by redirecting daylight and/or spotlighting incident on the panels onto the design and not into the eye of the observer. Optionally, daylight can be redirected partly onto the ceiling, to compensate for the shading effect of the design and base pattern. Existing privacy glazing panels according to the '292 invention typically are manufactured to have a silhouette pattern of black dots or lines facing inside the room to assist vision out. A translucent base pattern layer of black or grey marking material may be incorporated into embodiments of the present invention, typically with a superimposed white base pattern layer as a background on which to apply the design colours.

Panels of the invention may be edge lit. Edge lighting of panels according to GB Pat. No. 2165292 was disclosed in that document. Light is internally reflected down a sheet of transparent material. That light which is incident on the design applied to one surface of the panel is scattered and some of the scattered rays pass out of the other side of the panel, making the design visible to an observer. However, such panels have a disadvantage in that from the one side of the panel, an observer typically sees an unwanted mirror image of the design which is reflected off the other panel surface. A design applied to the one surface and facing a panel of the present invention is seen as a mirror image of the design from the one side of the panel. The reflection from the other surface, of a mirror image of the design, thus reinforces the visual impact of such an edge lit sign. Thus, the present invention provides an improvement to edge lit signs.

GB Pat. No. 2165292 discloses the projection of designs onto an opaque silhouette pattern, for example by a slide projector. An embodiment of the present invention of a projected design onto a translucent base pattern represents an improvement over the prior art, in that the projected design is visible from one side of a panel and a mirror image of the design is seen from the other side, as well as the panel allowing through vision. For example, a panel with a base pattern comprising a white layer may be installed in a retail store window. This base pattern will typically allow visibility in and out of the shop during the daylight or opening hours. When the shop is closed during the hours of darkness, images may be projected onto the panel in the store window from inside the store, for example as a promotional display. This range of features is not possible with the prior art of the '292 invention or conventional back projection screens.

BRIEF DESCRIPTION OF THE DRAWINGS

Further specific embodiments will now be described by way of example with reference to the accompanying drawings in which.

DETAILED DESCRIPTION OF THE INVENTION

Figure 1:
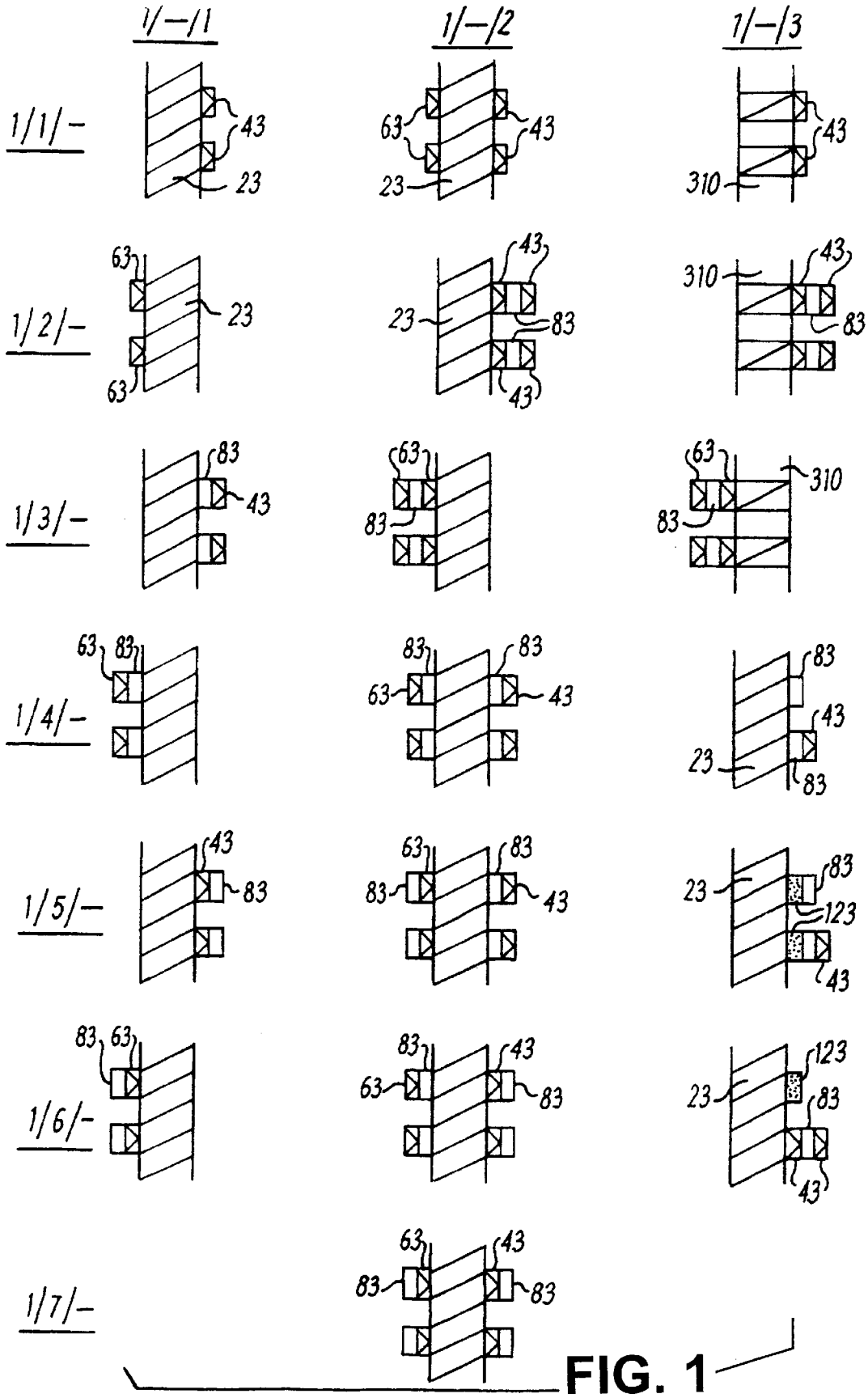
FIG. 1 illustrates a variety of arrangements of light permeable material and applied designs and base layers which may be advantageously adopted depending on the functional requirements of a particular product.

FIGS. 1/1–6/1 illustrate six embodiments with an imperforate transparent or translucent material 23 with a single design printed 'recto' 43 or a single design printed 'verso' 63, some embodiments having a translucent base layer 83, which for example comprises one or more layers of white ink or one or more layers of white ink on a layer of black or grey ink.

FIGS. 1/1–1/2 illustrate seven embodiments with an imperforate transparent or translucent material 23 with two design impressions, either printed 'recto' 43 or 'verso' 63 or one 'recto' 43 and one 'verso' 63 and a translucent base layer 83. All of these thirteen embodiments can have equivalent arrangements but with a perforated transparent or translucent material.

FIGS. 1/1–1/3 illustrate just three such embodiments in which the perforated material 310 is imaged in similar arrangements of 'recto' design 43, 'verso' design 63 and base layer 83 to the embodiments in FIGS. 1/1/1, 1/2/2 and 1/3/2 respectively.

FIGS. 1/4/3 illustrate a panel having a design over only part of a translucent white base layer. FIGS. 1/5/3 and 1/6/3 illustrates panels having more than one base layer, for example base layer 123 could be a translucent greytone which permits better vision through the panel than a translucent white base layer 83. There are many other possible configurations.

Figure 2:
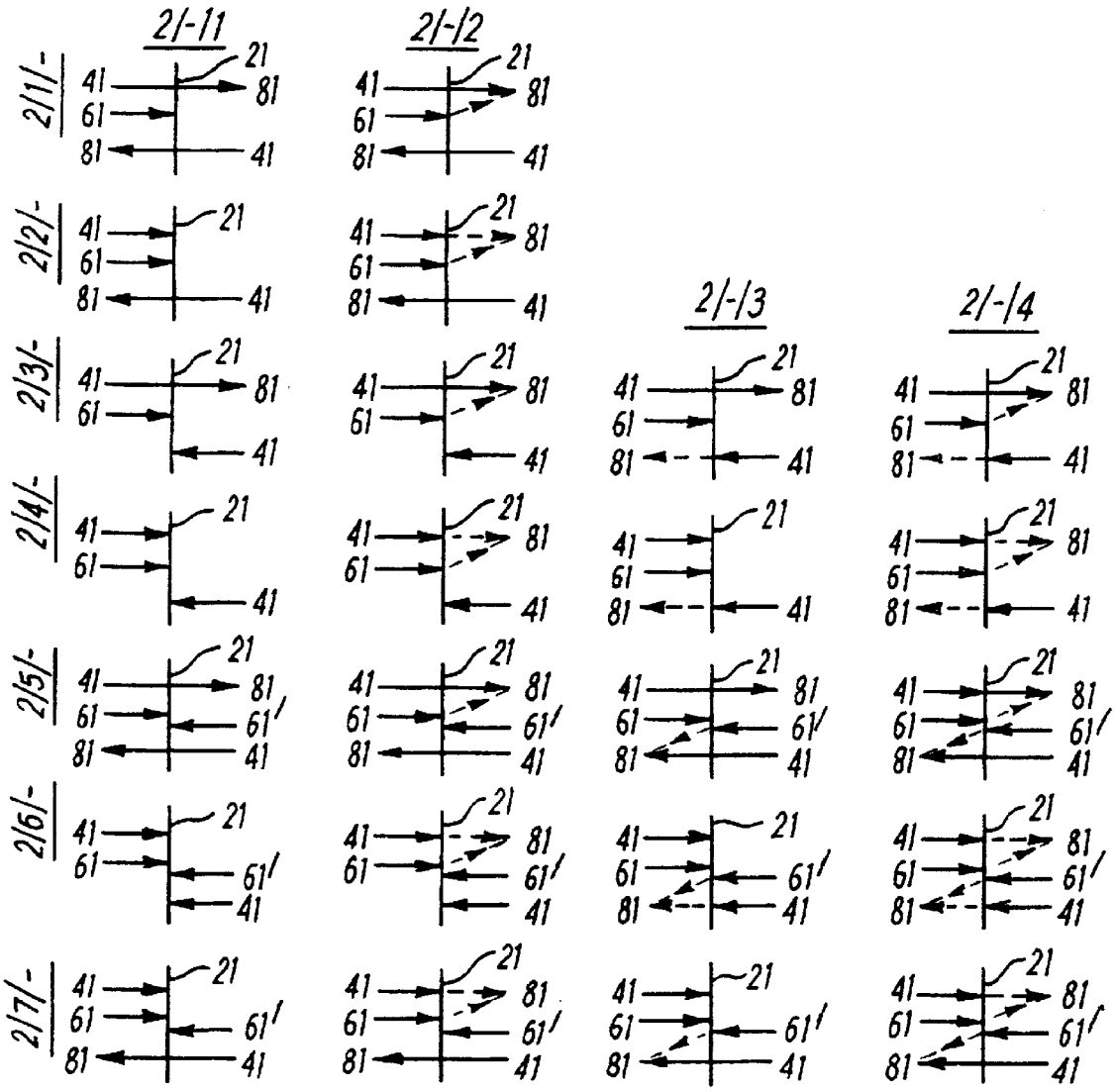
FIG. 2 illustrates a number of vision control effects obtainable from the invention.

FIG. 2 illustrates a number of vision control effects enabled by the invention. In each diagram, 21 represents a panel of the invention, 41 represents attempted vision through a panel 21, 81 being an object visible beyond the panel, otherwise through vision is obstructed and terminated by panel 21 or the dashed lines indicate alternative vision that can be optionally concentrated upon the design 61 and/or the base pattern on the panel or can be concentrated on the object 81, at the will of the viewer. 61 represents vision of a design on the left hand side of the panel and 61' represents vision of a mirror image of the design on the right hand side of the panel. The different vision control effects are enabled by selection of base patterns, designs and lighting conditions applied to panels.

FIG. 3 illustrates optional arrangements for illuminating panels of the invention.

Figure 3A:
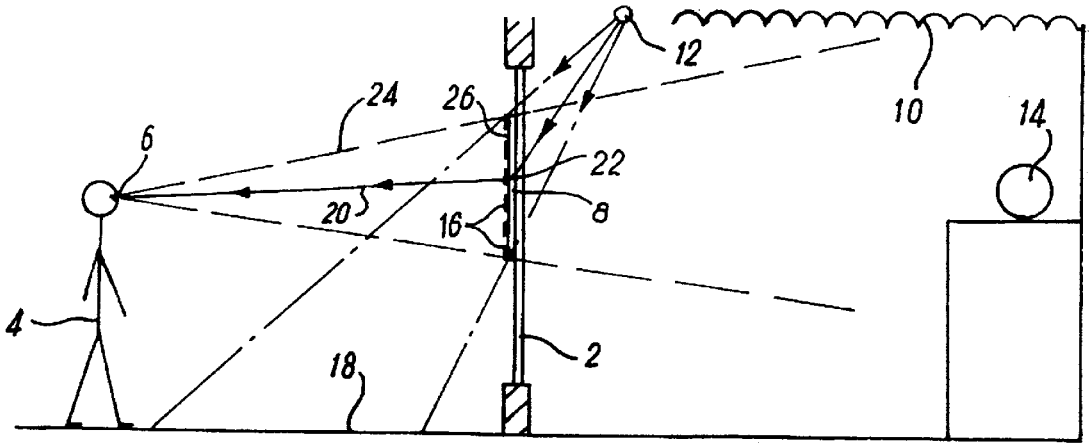
FIG. 3 illustrates optional arrangements for illustrating panels of the invention.

FIG. 3A is a diagrammatic cross-section through the window 2 in a building with a panel of the invention 8 attached to the window 2 with a design 16 facing outside the building towards an observer 4. General sources of internal illumination 10 illuminate the internal space inside the window, including object 14 which is visible to the observer 4 through the panel 8. An internal spotlight 12 can be directed onto the inside of the panel 8. Rays of light from the spotlight 12 incident upon the transparent neutral background 26 of panel 8 are transmitted onto projected area 18 on the floor and do not cause glare in the eye 6 of the observer 4. Light incident on base pattern 22 is scattered and example ray of light 20 from spotlight 12 is redirected through the base pattern 22 and design 16 towards the eye 6 of observer 4. The spotlight 12 is outside the line of sight of eye 6 throughout the area of the panel, the upper bound sightline 24 passing below the spotlight 12, with spotlight 12 not switched on, object 14 would typically be the principal perceived image of the observer 4 during the hours of darkness, with design 14 typically being only faintly visible. When spotlight 12 of sufficient luminous intensity is turned on, the principal perceived image of observer 4 changes from object 14 to design 16. By alternately switching the spotlight 12 on and off, the principal perceived image alternates between the design 16 to object 14 within the interior space. In the hours of daylight, it will typically be possible to see out of the window 2 through the panel 8.

Figure 3B:
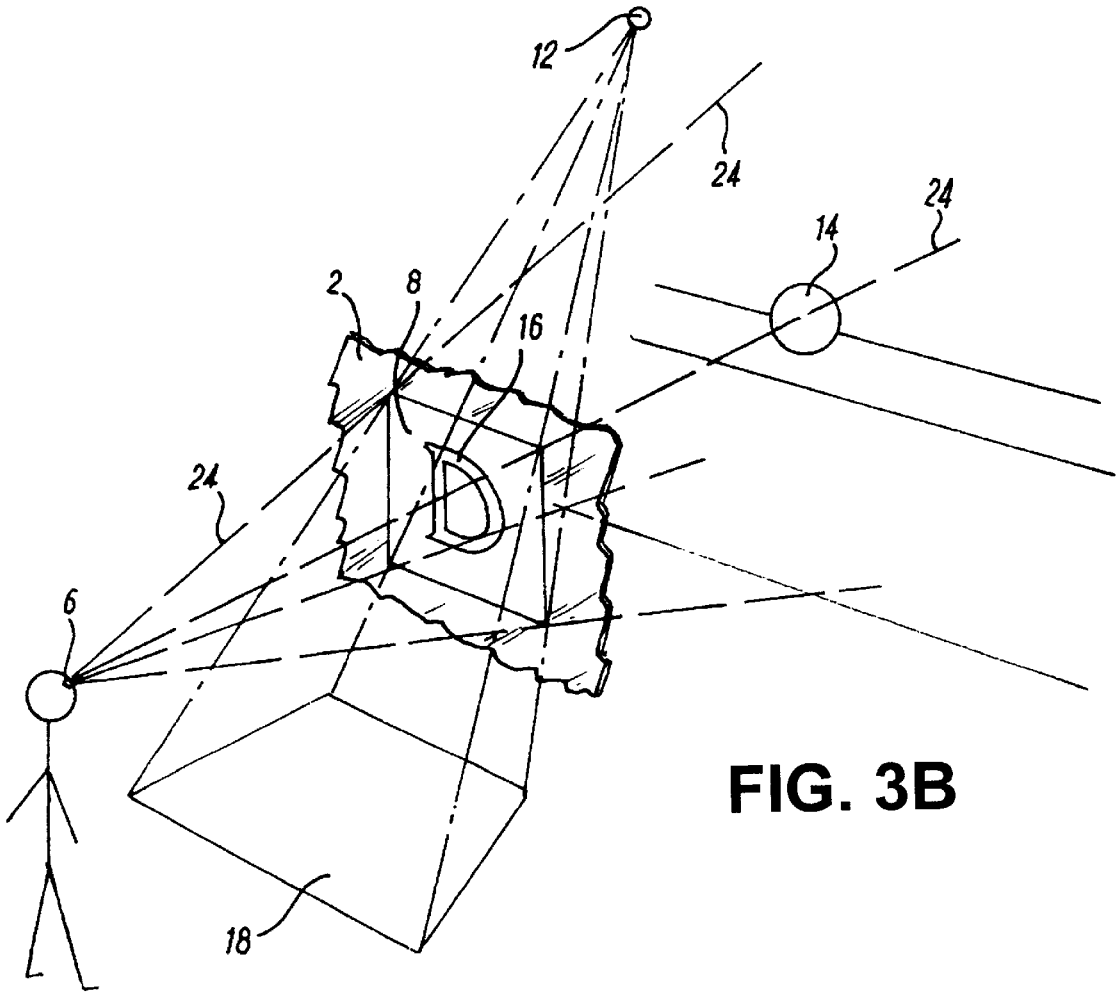

FIG. 3B is a diagrammatic partial perspective of FIG. 3A with window 2 partially cut away. The geometrical projection of the panel 8 from the spotlight 12 includes the light from spotlight 12 which passes through the transparent neutral background of panel 8 and which is incident on the floor over the area 18. The projected space between the panel 8 and the floor area 18 is termed the "projected panel volume". The eye 6 of observe 4 should be outside this projected panel volume for the spotlight 12 to effectively illuminate the design 16 on panel 8 in a way that improves the visibility of design 16 to observer 4. Correspondingly, the spotlight 12 should not be within the perimeter panel sightlines 24 of the eye 6 of observer 4 for the advantageous illumination of design 16 spotlight 12 without any resulting glare in the eye 6 of observer 4.

FIG. 4 is a diagrammatic cross-section of a panel of the invention R located in an opaque building partition 38. The panel 8 is constructed such that a design 16 is visible from one side (the left hand side) of the panel and its mirror image 16' is visible from the other side (the righthand side) of the panel. Sources of general illumination 30 and spotlight 32 are located on the one side of the panel, together with observer 4. Sources of general illumination 10 and spotlight 12 are located on the other side of the panel, together with observer 34. Observers 4 and 34 and panel 8 are aligned such that observer 4 also acts as an object 4 which may be visible by observer 34 and observer 34 also acts as an object 34 which may be visible by observer 4, depending on the conditions of illumination. All sources of illumination 10, 12, 30 and 32 are dimmable.

Figure 4A:
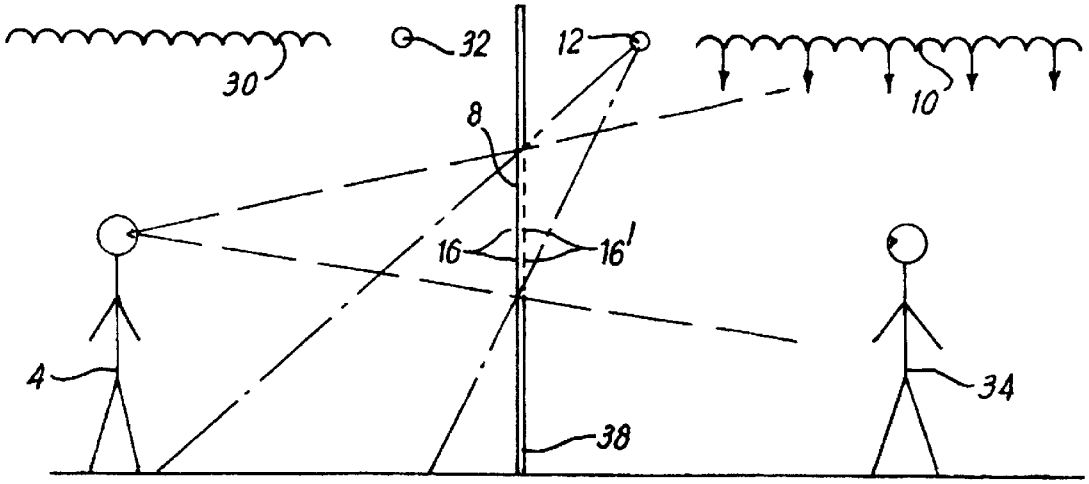
FIG. 4 is a diagrammatic cross-section of a panel located in an opaque partition wall.
Figure 4B:
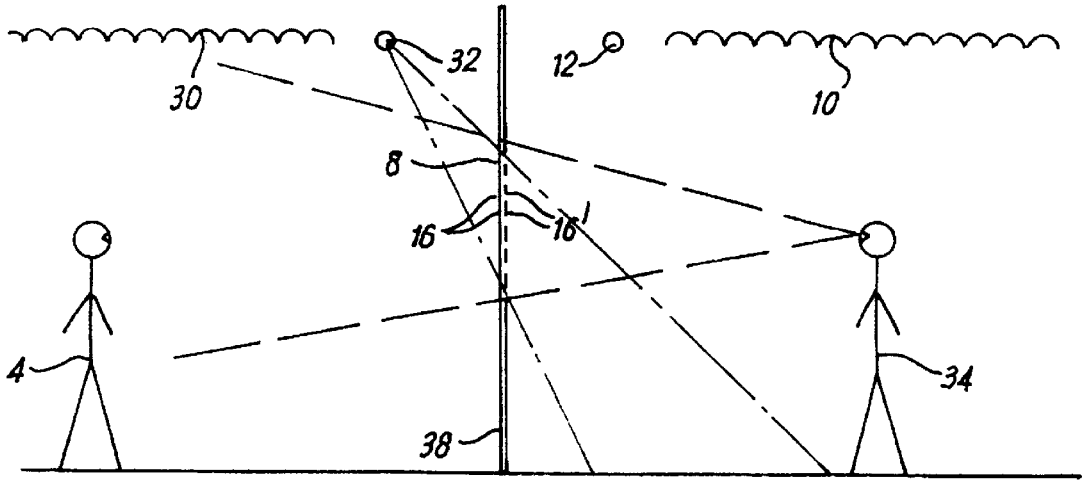

In FIG. 4A, if there is no illumination to either side of the panel, neither observer can see the panel or each other. In general lighting 10 alone is gradually raised in luminous intensity only to a level that object 34 just becomes clearly visible to observer 4, then design 16 is typically just faintly discernible also, but the principal perceived image comprises object 34. Spotlighting 12 can then be turned on and increased in luminous intensity until design 16 becomes the principal perceived image of observer 4. If panel 8 has a particularly low average transmissivity of the design and base pattern, it may be necessary to reduce general lighting 10 in order for design 16 to become the principal perceived image of observer 4. In either case the principal perceived image changes from the "through image" to the design 16 only by means of changing the illumination on the other side of panel 8. Depending on the construction of panel 8, the mirror image of the design 16' may be visible to observer 34 with just the general lighting 10 or spotlight 12 or both means of illumination. However, if a base portion layer masks the mirror image of the design 16', for example as illustrated in FIG. 1/3/1, then the mirror image of the design 16' can be made clearly visible to observer 34 as shown in FIG. 4B. With the other sources of illumination turned off, spotlight 32 is raised in luminous intensity until the otherwise masked mirror image of design 16' is clearly visible to observer 34.

Figure 4C:
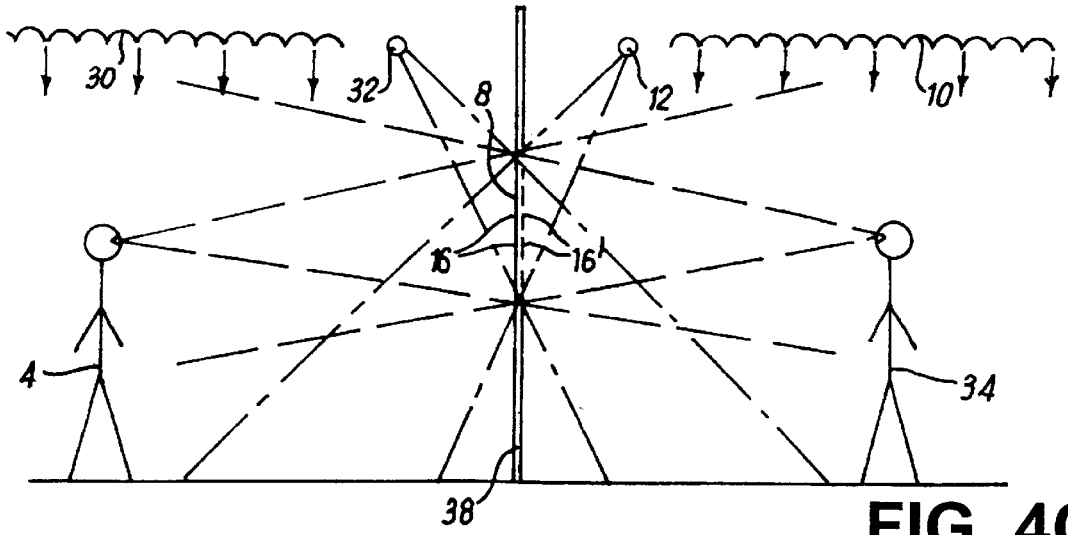

In FIG. 4C, general lighting 10 and 30 and spotlighting 12 and 32 can be adjusted so that the object 34 and design 16 are optionally visible to observer 4, who can concentrate on either image, and object 4 and the mirror image of the design 16' are optionally visible to observer 34.

With no illumination on the one side of the panel and only spotlight 12 illumination of the other side, good visibility of design 16 can typically be achieved with an average luminance of panel 8 of from 10–30 cd/m$^2$, as seen by observer 4. With levels of general illumination on the other side typical of building interiors, spotlighting 12 might be needed to increases the average luminance of panel 8 from 30–70 cd/m$^2$, as seen by observer 4, to achieve good visibility of design 16 with no illumination on the one side.

FIG. 5 illustrates three different panels 8 with different base patterns 22 and different superimposed designs 16.

Figure 5A:
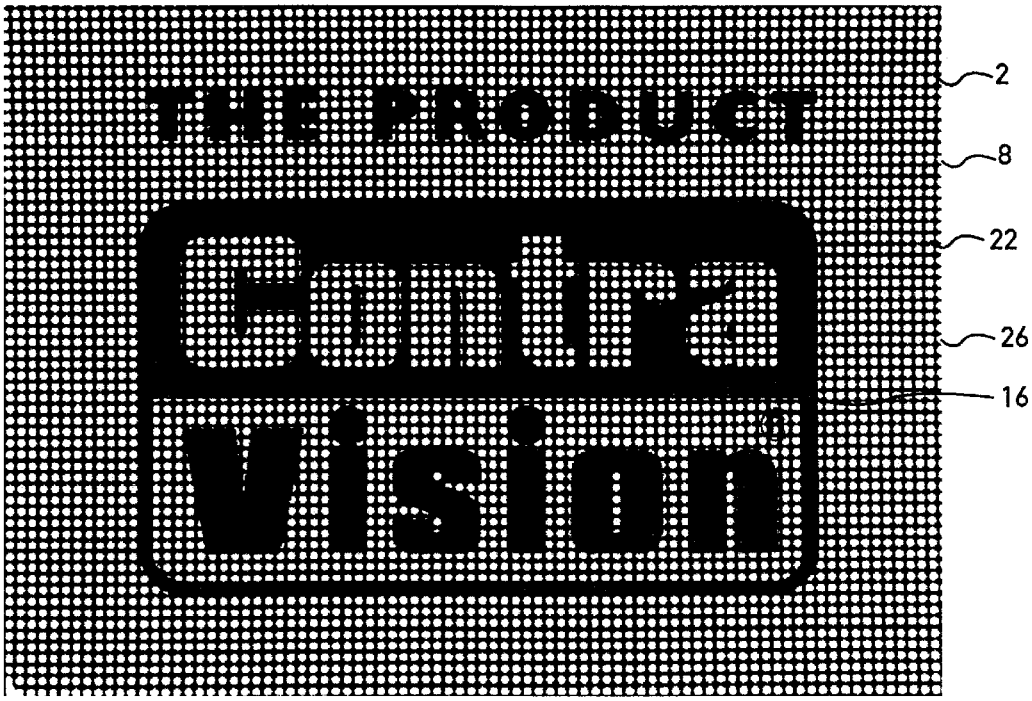
FIG. 5 illustrates three panels with different base patterns and designs.
Figure 5B:
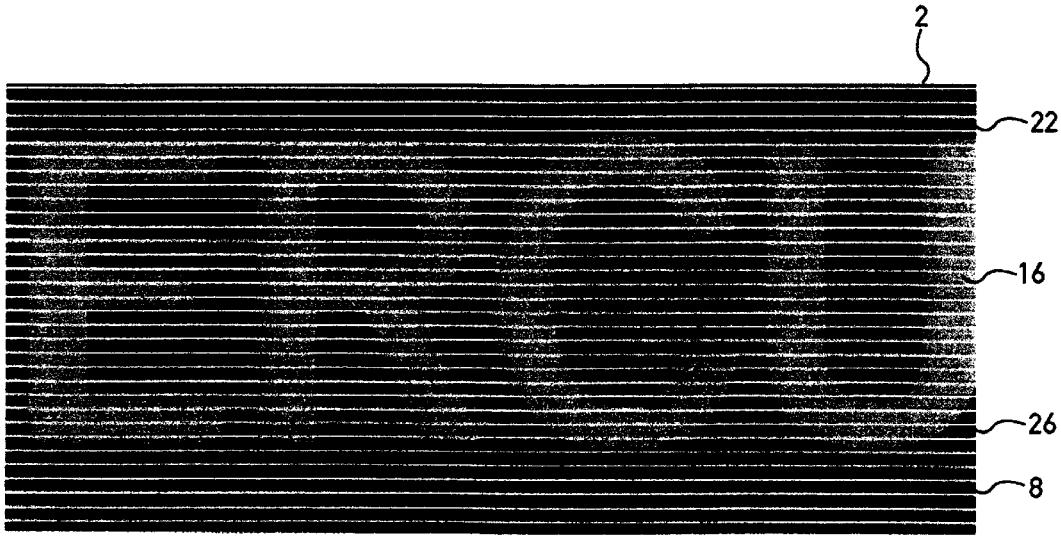

FIG. 5A illustrates a transparent film 2 of self-adhesive polyester film with a white, dot, translucent base pattern 22 and grey design 16 of indicia, typically printed by one of the methods outlined in CB2165292 or PCT/CB96/02600 to achieve substantially exact registration or close registration of design 16 superimposed on base pattern 22. The area of neutral background around the dots 26 appears dark, as if there is no illumination behind panel 8. The panel of FIG. 5B is of similar construction, but comprises a dark line base pattern 22 and a white indicia design 16 which may be superimposed on the base pattern or may alternatively comprise a white line base pattern revealed by the dark surround to the indicia.

Figure 5C:
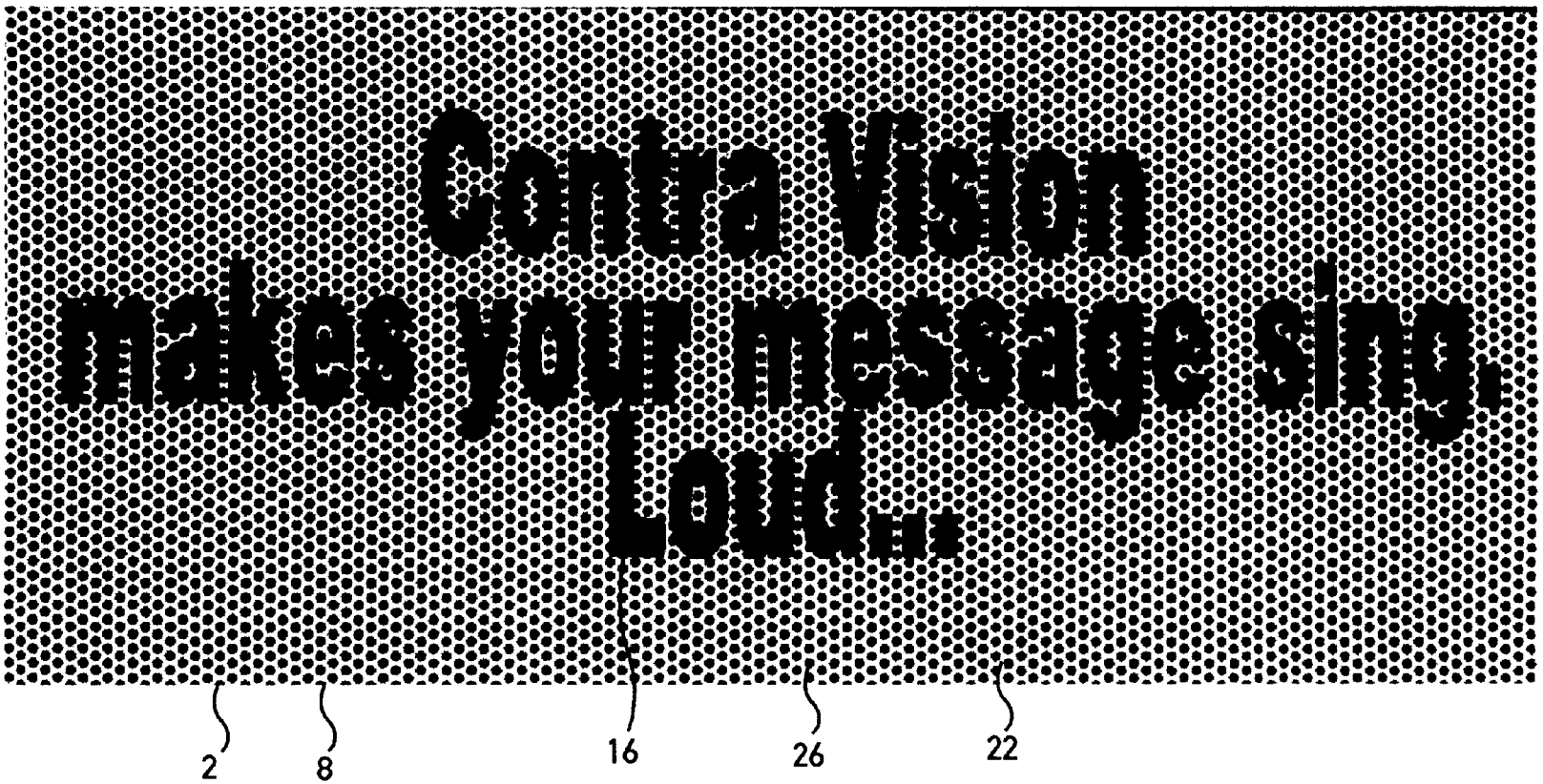

FIG. 5C illustrates a panel of different construction, having a white, perforated material base pattern 22 typically comprising a white polyvinyl chloride self-adhesive film 2 perforated by mechanical punching. Alternatively base pattern 22 could be a perforated transparent film coated with translucent white ink before or after perforation. Translucent design 16 of dark indicia is printed on the white base pattern, typically by screen printing or any method of digital printing. The circular hole perforation 26 are shown grey.

The self-adhesive materials above typically comprise a film layer, an adhesive layer and a liner which is removable in order to attach the film layer by means of the adhesive layer to a window or other transparent sheet material.

FIG. 6 illustrates opposite sides of the same panel 8.

Figure 6A:
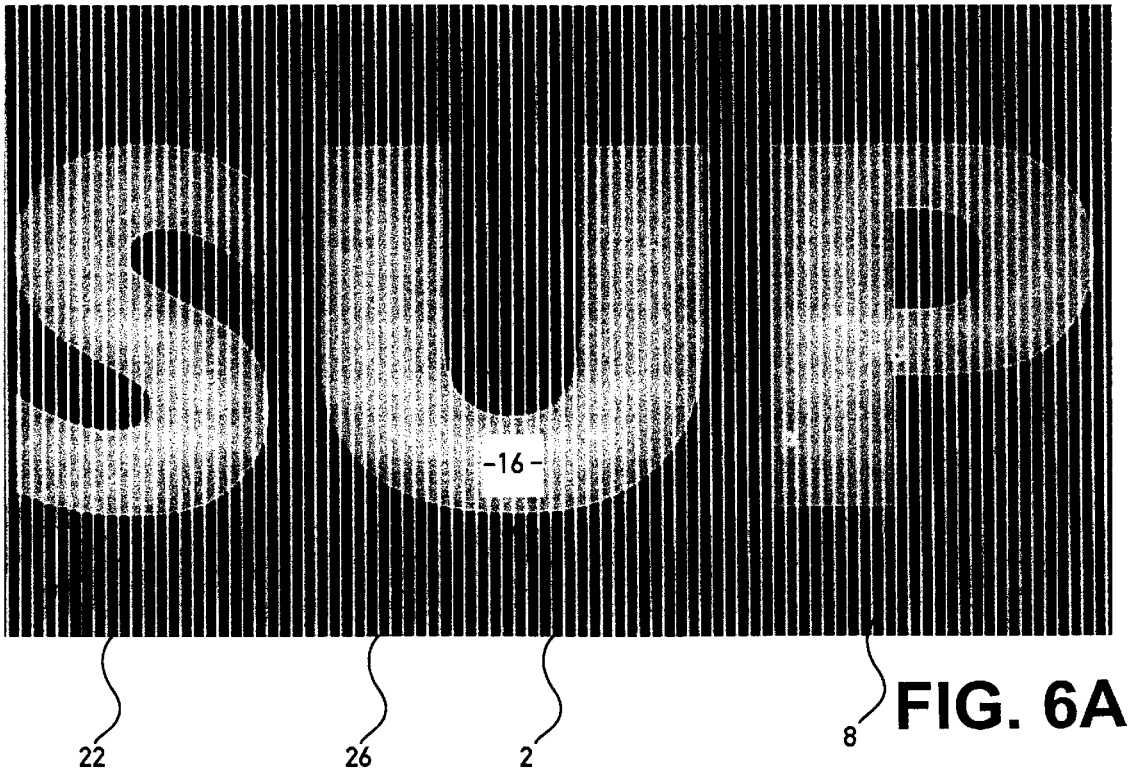
FIG. 6 illustrates opposite sides of another panel of the invention.

FIG. 6A illustrates one side of panel 8 with white indicia design 16 superimposed on a dark, line base pattern 22 with a clear transparent neutral background 26 being part of transparent sheet 2.

Figure 6B:
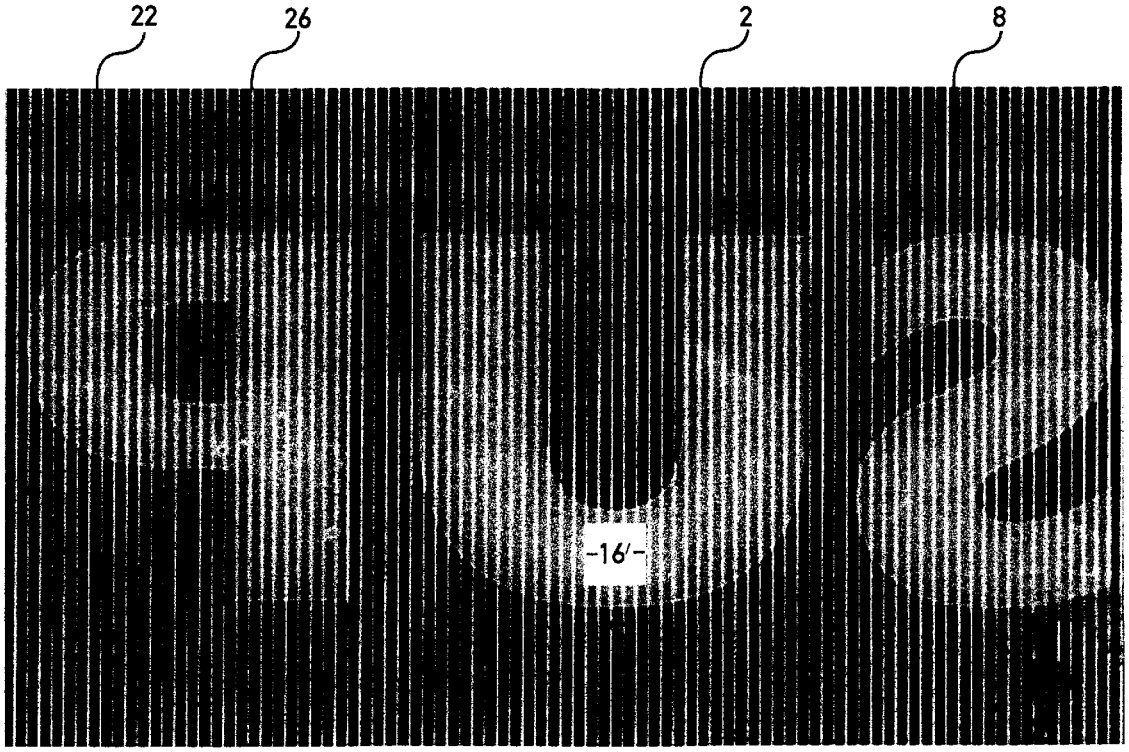

FIG. 6B illustrates the other side of panel 8 with the mirror image of the design 16' visible from the other side. FIG. 6B also illustrates the printing of a "verso" design on the other side of a panel to be seen in its correct form from the one side of the panel, similar to FIG. 1/3/2.

FIG. 7 illustrates two diagrammatic cross-sections through transparent sheet materials.

Figure 7A:
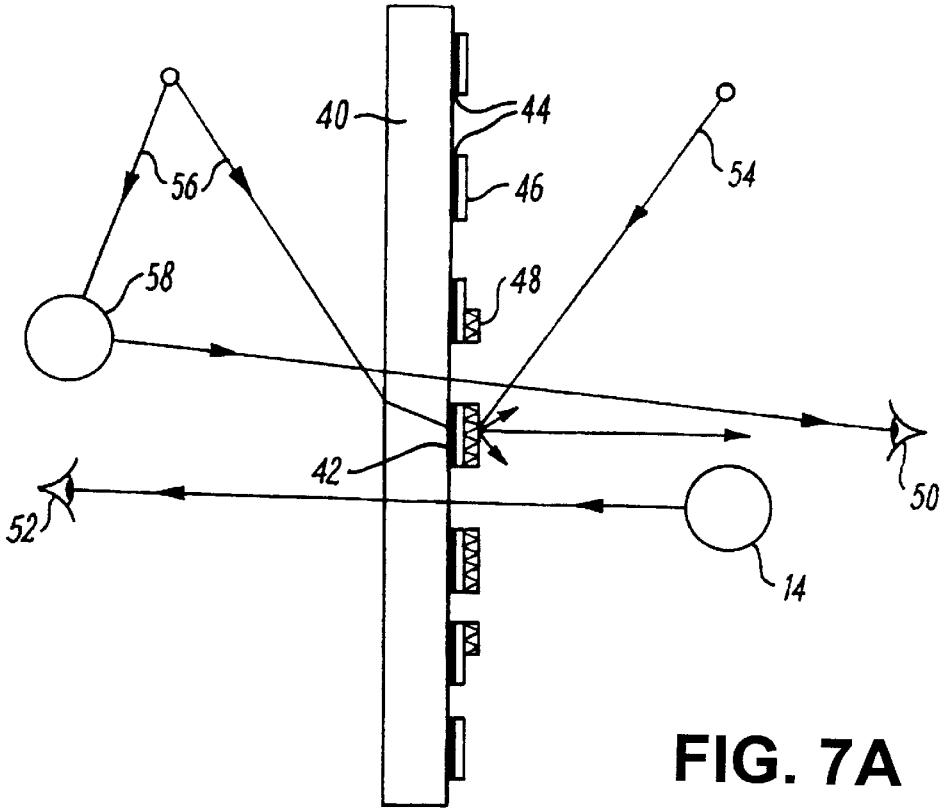
FIG. 7 illustrates two cross-sections through transparent sheet materials.

FIG. 7A is a cross-section through part of a typical panel of the '292 invention.

Figure 7B:
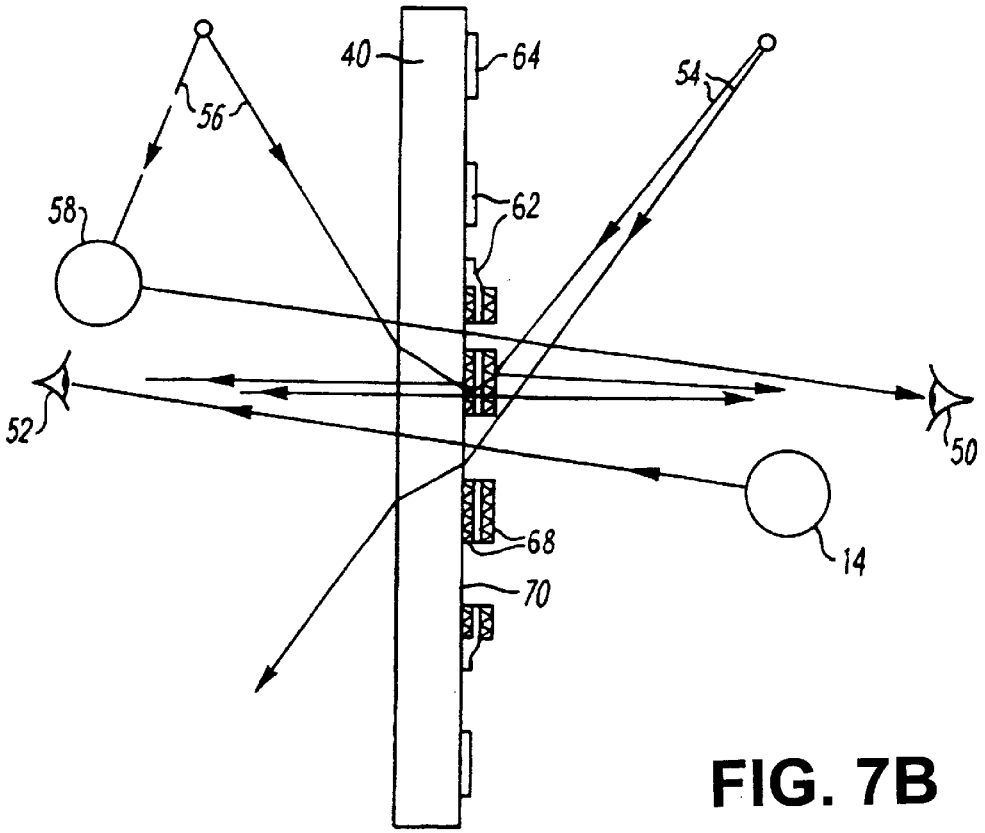

FIG. 7B is a cross-section through part of a typical panel of the present invention.

In FIG. 7A transparent sheet 40 is printed on one side with an opaque silhouette pattern of dots or lines comprising a black layer 44 and a white layer 46. A design 48 is superimposed on some of the opaque portions. Layers 44, 46 and 48 are superimposed with substantially exact registration such that design 48 is not visible from the other side of sheet 40 to an observer 4. Light 54 from the one side, incident on design 48, is reflected and scattered, enabling observer 50 on the one side to see the design 48. Light 56 from the other side is refracted through the transparent sheet 40 and is absorbed by the black layer 44, enabling substantially unobstructed vision through the transparent portions between the black silhouette pattern portions, providing good visibility of object 14 on the one side, the opaque silhouette pattern portions being of sufficiently small width, typically of the order of 1 mm, to be unresolvable by the eye from a certain distance. Depending on the conditions of illumination, observer 50 can optionally see object 58 on the other side or design 48. If there is no light 54 but light 56 illuminates object 58, for example if observer 50 is outside a building during the hours of darkness and sheet 40 is a window in the building, internal illumination 56 will typically cause object 58 to be the principal perceived image seen by observer 50.

FIG. 7B illustrates a panel of the present invention constructed in a similar manner to FIG. 1/2/2. Transparent sheet 40 has two sides and two outer edges. A cross-section through the panel comprises alternate transparent portions and translucent portions of the base pattern. The translucent portions comprise a printed, translucent, white base pattern layer 64 and a translucent design layer 68 is printed "recto" on the transparent sheet 40 and a separate translucent design layer 68 is printed also "recto" on the base pattern layer 64. The two design layers 68 and the base pattern layer 64 are typically printed by one of the methods outlined in GB2165292 or PCT/GB96/02600 to achieve substantially exact registration or close registration of the three layers. Each of the three layers may comprise multiple layers or multiple applications of ink, for example the design 68 could be printed by a four color printing process. Part of the light 54 from the one side incident on transparent portions 70 is refracted through the transparent sheet 40. Part of the light 54 from the one side incident on design 68 or base pattern 64 is reflected and scattered, enabling observer 50 on the one side to see design 68. Another part of the light 54 incident on design 68 or base pattern 64 is transmitted through the translucent portions and is scattered and retracted through the transparent sheet 40 enabling observer 52 on the other side of the panel 50 see a mirror image of design 68 by virtue of light 54 from the one side. Similarly, observer 50 can see design 68 by virtue of light 56 from the other side, transmitted through the translucent portions 62. For example, if sheet 40 is the window of a building and sufficient internal illumination 56 is concentrated on the inside of sheet 40 during the hours of darkness, then the principal perceived image seen by observer 50 outside the building will be the design 68 and not internal object 58, the opposite effect to that resulting from similar conditions of illuminating a panel of the '292 invention as described for FIG. 7A. It can be seen that visibility of a design or visibility through a panel from either side can be controlled by the illumination on either side of the panel.

FIG. 8 illustrates cross-sections through Light Redirecting Materials and their components.

Figure 8A:
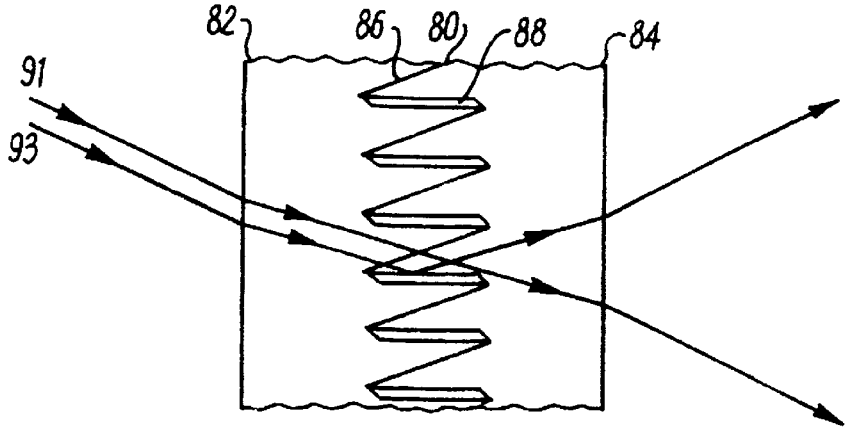
FIG. 8 illustrates cross-sections through Light Redirecting Materials and components thereof.

FIG. 8A is a cross-section through SERRAGLAZE film 80 of de Montford, Lichfield, United Kingdom, manufactured by the Minnesota Manufacturing and Mining Company in two components 82 and 84 which are adhered together at surfaces 86 leaving air gaps 88. The air gaps 88 form discontinuities or "air shelves" which cause internal reflection of light rays within a range of angles dependent upon material used, typically acrylic or polycarbonate. Light ray 91 is conventionally refracted downwards through the material whereas ray 93 is internally reflected upwards. The material is intended to be used to improve the daylighting through building windows by reflecting a proportion of incident daylight upwards onto the ceilings of rooms, which are typically light and reflective and "throw" the daylight further inside the interior space.

Figure 8B:
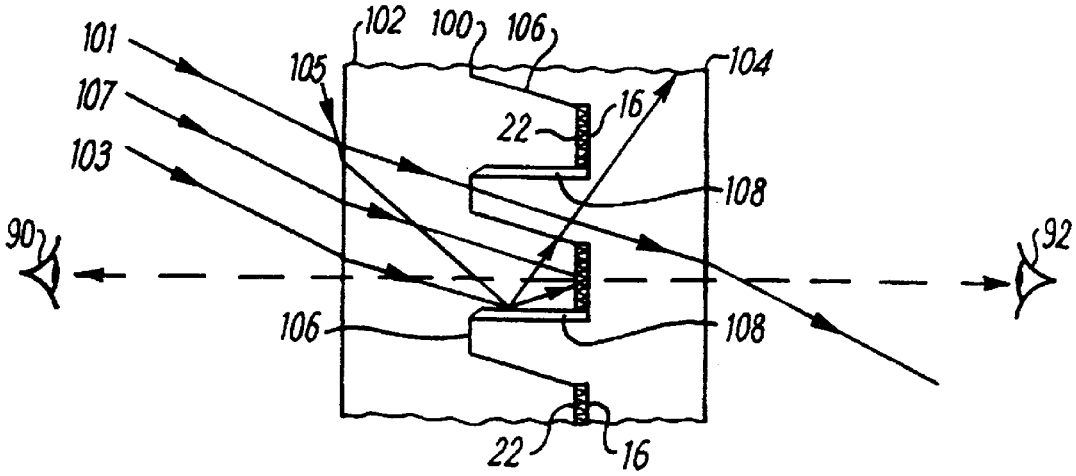

FIG. 8B is a cross-section through a panel 100 of the present invention similarly formed of two components 102 and 104 of combined width of between 2 mm and 10 mm, typically of acrylic or polycarbonate. The components interlock and are adhered at surfaces 106 leaving air gaps 108. Daylight rays incident on the panel and refracted into the panel are redirected. Light ray 101 is refracted down through the panel. Light ray 103 is reflected off the air gap 108 onto design 16 and base pattern 22. Light ray 107 is incident on design 16 and base pattern 22. Light ray 105 is reflected off air gap 108 upwards. Thus such a light redirecting panel increases the light incident on a design and base pattern and, therefore, their visibility. If used as a privacy glazing material or a sign in a building window, the shading effect of the base pattern is partly compensated by the improvement to daylighting caused by reflecting rays towards a ceiling. Conversely, if the panel is considered to be reversed and rays 101, 103, 105 and 107 result from internal spotlighting, the visibility of the design and the privacy achieved during the hours of darkness are improved.

Figure 8C:
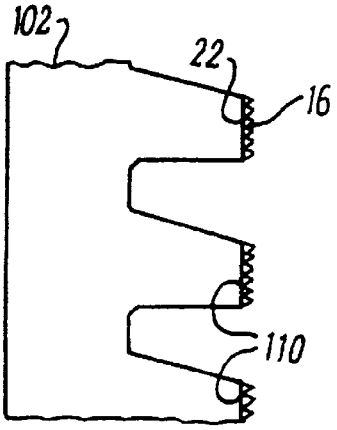

FIG. 8C is a cross-section through component 102. It can be seen that flat surfaces 110 of the castellated cross-section facilitate imaging with a base pattern and design with exact registration by many printing processes, including screen printing and transfer processes in which an overall continuous layer of ink or transferred material can be applied to surface 110, but would not be able to image the recesses between these protruding surfaces.

Figure 8D:
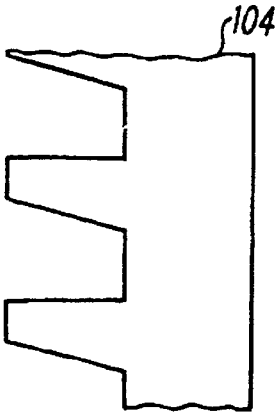

FIG. 8D is a cross-section through component 104. Many other embodiments of the invention enhanced by light redirecting configuration are possible.

What is claimed is:

1. A panel comprising a sheet of colored or colorless transparent material and a transparent or translucent design, said transparent or translucent design being superimposed with a base pattern which extends over the area of said sheet covered by said design and being adhered to at least one of said base pattern and said sheet of colored or colorless transparent material, said base pattern comprising a translucent base layer and subdividing the panel into a plurality of areas of said base layer and/or a plurality of areas of said colored or colorless transparent material, said layers being constructed and arranged such that the whole of said design is visible from a first viewing position located on one side of the panel when a sufficiently high level of illumination is provided on the other side of the panel and a mirror of the whole of said design is visible from a second viewing position located on the other side of the panel when a sufficiently high level of illumination is provided on said one side of the panel.

2. A panel as claimed in claim 1, wherein said base pattern is extends over the entirely of said sheet.

3. A panel as claimed in claim 1, wherein said base pattern comprises a plurality of geometric elements arranged in a regular layout.

4. A panel as claimed in claim 1, wherein said base pattern comprises an even continuum.

5. A panel as claimed in claim 1, wherein a cross-section of the panel comprises two outer edges of said sheet of colored or colorless transparent material and alternate translucent portions and transparent portions of said panel, and wherein the average width of said translucent portions is less than 6 mm and the average width of said transparent portions is less than 3 mm.

6. A panel as claimed in claim 5, wherein the average width of said translucent portions is less than 2 mm and the average width of said transparent portions is less than 2 mm.

7. A panel as claimed claim 1, wherein the ratio of base pattern area: transparent area is in the range of 1:1 to 4:1.

8. A panel as claimed in claim 1, wherein said base layer comprises an ink.

9. A panel as claimed in claim 1, wherein said base layer is white.

10. A panel as claimed in claim 1, wherein said base layer comprises a grey material.

11. A panel as claimed in claim 1, wherein said base pattern comprises a perforated, translucent material.

12. A panel as claimed in claim 1, wherein said sheet of transparent material is imperforate.

13. A panel as claimed in claim 1, wherein said sheet of transparent material is perforated.

14. A panel as claimed in claim 1, wherein said panel is configured such that an observer on one side of the panel can see through the panel when the level of illumination perceived through the panel from the other side of the panel sufficiently exceeds the illumination reflected by said panel when observed from said one side of the panel, and an observer on said other side of said panel can see through the panel when the level of illumination perceived through the panel from said one side of the panel sufficiently exceeds the illumination reflected by said panel when observed from said other side of the panel.

15. A panel as claimed in claim 5 or claim 6, wherein said design comprises a design layer and wherein, within each of the translucent portions, said base layer has two outer edges and said design layer has two outer edges and the two outer edges of said design layer are located within the two outer edges of said base layer.

16. A panel as claimed in claim 1, wherein a first design layer is printed onto said sheet of colored or colorless transparent material, said base layer is printed onto said first design layer, and a second design layer, substantially identical to said first design layer, is printed onto said base layer.

17. A panel as claimed in claim 1, wherein the mirror image of said design is printed onto said sheet of colored or colorless transparent material.

18. A panel as claimed in claim 1, wherein the mirror image of said design is printed onto said base layer.

19. A panel as claimed in claim 1, wherein said design and said base pattern have been formed by offset litho printing.

20. A panel as claimed in claim 1, wherein said design and said pattern have been formed by a digital printing system.

21. A panel as claimed in claim 1, wherein said design and said base pattern have been formed by ink jet printing.

22. A panel as claimed in claim 1, wherein said design has been applied by means of transfer from a carrying surface or membrane.

23. A panel as claimed in claim 1, wherein said design has been applied by means of ceramic ink transfer.

24. A panel as claimed in claim 1, wherein said design has been printed by a four colour print process.

25. A panel as claimed in claim 1, wherein said panel has a light redirecting surface disposed between front and rear surfaces thereof substantially at an angle to said front and rear surfaces, said light redirecting surface being configured and disposed so as to redirect incident light by reflection.

26. A panel as claimed in claim 25, wherein said light redirecting surface includes at least one surface formed as part of a prismatic projection of said sheet of colored or colorless transparent material.

27. A panel as claimed in claim 25, wherein said light redirecting surface includes at least one surface formed as part of a prismatic recess of said sheet of colored or colorless transparent material.

28. A panel as claimed in claim 25, wherein said panel has a void formed therein and said light redirecting surface constitutes a boundary of said void.

29. A panel as claimed in claim 25, wherein said design and said base layer are disposed between said front and rear surfaces of said panel.

30. A panel as claimed in claim 1, wherein the design and base pattern have an average light transmissivity of at least 1%.

31. A panel as claimed in claim 1, wherein the design and base pattern have an average light transmissivity of greater than 3%.

32. A panel as claimed in claim 1, wherein said design is superimposed with said base pattern by projection from one side of said panel, whereby said design is visible from said one side of said panel and a mirror image of said design is visible from the other side of said panel.

33. An illuminated panel assembly, comprising:

a panel comprising a sheet of colored or colorless transparent material and a transparent or translucent design, said transparent or translucent design being superimposed with a base pattern which extends over the area of said sheet covered by said design and being adhered to at least one of said base pattern and said sheet of colored or colorless transparent material, said base pattern comprising a translucent base layer and subdividing the panel into a plurality of areas of said base layer and/or a plurality of areas of said colored or colorless transparent material, said layers being constructed and arranged such that the whole of said design is visible from a first viewing position located on one side of the panel when a sufficiently high level of illumination is provided on the other side of the panel and a mirror image of the whole of said design is visible from a second viewing position located on the other side of the panel when a sufficiently high level of illumination is provided on said one side of the panel; and a spotlight source of illumination located on said other side of said panel, outside a prismatic space formed by a projection of said panel perpendicular to said panel and directed to illuminate said other side of said panel;

whereby the perceptibility of the design perceived by an observer located at said first viewing position, with the spotlight source of illumination shielded from the observer by an opaque material disposed between the observer and the spotlight source of illumination such that the spotlight source of illumination is outside any direct line of sight from the viewer, is substantially increased by shining the spotlight source of illumination on said other said of said panel.

34. A method of displaying a transparent or translucent design, said method comprising:

providing a panel comprising a sheet of colored or colorless transparent material having said transparent or translucent design printed thereon, said transparent or translucent design being superimposed with a base pattern which extends over the area of said sheet covered by said design and being adhered to at least one of said base pattern and said sheet of colored or colorless transparent material, said base pattern comprising a translucent base layer and subdividing the panel into a plurality of areas of said base layer and/or a plurality of areas of said colored or colorless transparent material, said layers being constructed and arranged such that the whole of said design is visible from a first viewing position located on one side of the panel when a sufficiently high level of illumination is provided on the other side of the panel and a mirror image of the whole of said design is visible from a second viewing position located on the other side of the panel when a sufficiently high level of illumination is provided on said one side of the panel; and illuminating the panel on said other side of said panel with a first spotlight source of illumination, said first spotlight source of illumination being located outside a prismatic space formed by a projection of said panel perpendicular to said panel and said first spotlight source of illumination being directed onto said other side of said panel.

35. A method of displaying a transparent or translucent design as claimed in claim 34, further comprising increasing the luminous intensity of said first spotlight source illumination on said other side of said panel to increase the luminance and perceptibility of said design from said first viewing position.

36. A method of displaying a transparent or translucent design as claimed in claim 35, said method further comprising controlling the perceptibility from said first viewing position of said design and an object spaced from the other side of the panel, opposite to said first viewing position and with said panel disposed therebetween, by:

a) illuminating the space on said other side of the panel with a source of general illumination of sufficient luminous intensity such that, when said first spotlight source of illumination is not switched on, said object forms a principal perceived image from said first viewing position; and b) switching on said first spotlight source of illumination at a sufficient level of luminous intensity such that the principal perceived image from said first viewing position changes from said object to said design.

37. A method of illuminating a panel as claimed in claim 36, said method further comprising selecting the level of illumination provided by each of the illumination sources whereby a principal perceived image visible at said first viewing position alternates between said design and said object.

38. A method of displaying a transparent or translucent design as claimed in claim 34, said method further comprising a) variably illuminating the panel on said other side of said panel with said first spotlight source of illumination, b) variably illuminating the space on said other side of said panel with a first source of general illumination, c) variably illuminating said one side of said panel with a second spotlight source of illumination directed onto said one side of said panel, and/or d) variably illuminating the space on said one side of said panel with a second source of general illumination.

39. A method of displaying a transparent or translucent design as claimed in claim 38, said method further comprising selecting the level of illumination provided by each of the illumination sources such that 1) a first observer at said first viewing position on said one side of said panel can optionally see both the design and a second observer at said second viewing position on said other side of said panel; and 2) said second observer can optionally see both a mirror image of said design and said first observer at said first viewing position on said one side of said panel.

40. A method of illuminating a panel as claimed in claim 39, said method further comprising increasing the luminous intensity of said first source of general illumination until said second observer located at said second viewing position is visible to and forms the principal perceived image for said first observer located at said first viewing position, and then increasing the luminous intensity of said first spotlight source of illumination whereby said design becomes a principal perceived image for said first observer located at said first viewing position.

41. A method of illuminating a panel as claimed in claim 38, further comprising increasing the luminous intensity of said second spotlight source of illumination until a mirror image of said design is visible to an observer located at said second viewing position on said other side of said panel.

42. A method as claimed in claim 34, wherein said method comprises projecting said design onto said base layer using said first spotlight source of illumination, whereby said design is visible from said one side of said panel and a mirror image of said design is visible from the other side of said panel.

43. A panel as claimed in claim 3, wherein all of said geometric elements have the same shape.

44. A panel as claimed in claim 1, wherein said design is visually independent of said base pattern such that at least a part of said design remains clearly perceptible to an observer on said one side of said panel even when the observer has moved far enough away from said panel that individual elements of said base pattern no longer can be resolved by the eye of the observer.

45. A panel as claimed in claimed 1, wherein said base pattern comprises a perforated, transparent material.

46. A panel as claimed in claim 1, wherein said sheet of colored or colorless transparent material comprises a partially metallized mirror material.

47. An illuminated panel assembly as claimed in claim 33, wherein a mirror material is spaced from the other side of said panel.

48. An illuminated panel assembly as claimed in claim 47, wherein said mirror material is a partially metallized mirror material.

49. An illuminated panel assembly as claimed in claim 33, said assembly further comprising a rear design panel that is spaced from the other side of said panel and a second spotlight source of illumination that is directed to illuminate said rear design panel.

* * * * *